US009458561B2

(12) United States Patent
Tokura

(10) Patent No.: US 9,458,561 B2
(45) Date of Patent: Oct. 4, 2016

(54) SEWING MACHINE AND NON-TRANSITORY COMPUTER-READABLE MEDIUM STORING COMPUTER-READABLE INSTRUCTIONS

(71) Applicant: BROTHER KOGYO KABUSHIKI KAISHA, Nagoya-shi, Aichi-ken (JP)

(72) Inventor: Masashi Tokura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 56 days.

(21) Appl. No.: 14/636,739

(22) Filed: Mar. 3, 2015

(65) Prior Publication Data

US 2015/0259837 A1 Sep. 17, 2015

(30) Foreign Application Priority Data

Mar. 14, 2014 (JP) ..... 2014-051148

(51) Int. Cl.

| | |
|---|---|
| ***D05B 19/08*** | (2006.01) |
| ***D05B 19/10*** | (2006.01) |
| ***D05B 21/00*** | (2006.01) |
| ***D05C 5/06*** | (2006.01) |

(52) U.S. Cl.

CPC ..... *D05B 19/08* (2013.01); *D05B 19/10* (2013.01); *D05B 21/00* (2013.01); *D05C 5/06* (2013.01)

(58) Field of Classification Search

CPC ..... D05B 19/02; D05B 19/00; D05B 19/04; D05B 19/08; D05B 19/10; D05B 19/12; D05B 21/00; D05C 5/06; G05B 2219/45195; G05B 19/408; G05B 19/409

See application file for complete search history.

(56) References Cited

U.S. PATENT DOCUMENTS

| | | | | |
|---|---|---|---|---|
| 7,484,466 | B2 | 2/2009 | Kuki et al. | |
| 8,606,390 | B2 | 12/2013 | Hjalmarsson et al. | |
| 2005/0283268 | A1* | 12/2005 | Hagino | D05B 19/10 700/138 |
| 2007/0227420 | A1 | 10/2007 | Suzuki et al. | |
| 2007/0233310 | A1 | 10/2007 | Yamada | |
| 2008/0103624 | A1 | 5/2008 | Yamada | |
| 2009/0144173 | A1* | 6/2009 | Mo | G06N 3/006 705/26.1 |
| 2009/0188413 | A1 | 7/2009 | Hirata et al. | |
| 2009/0217850 | A1 | 9/2009 | Tokura | |

(Continued)

FOREIGN PATENT DOCUMENTS

| | | | |
|---|---|---|---|
| EP | 2292824 | A2 | 3/2011 |
| EP | 2 366 823 | A2 | 9/2011 |

(Continued)

OTHER PUBLICATIONS

Jul. 22, 2015 Extended Search Report issued in European Patent Application No. 15158900.9.

(Continued)

*Primary Examiner* — Ismael Izaguirre
(74) *Attorney, Agent, or Firm* — Oliff PLC

(57) ABSTRACT

A sewing machine includes a needle bar, an image capture device, and a control device. A sewing needle is mounted on a lower end of the needle bar. The image capture device captures an image of an area that includes an area below the needle bar. The image capture device also creates image data. The control device is configured to execute steps including causing the image capture device to create first image data, causing the image capture device to create second image data, acquiring the first image data, acquiring the second image data, and performing color-related correction on the second image data, based on the first image data.

14 Claims, 16 Drawing Sheets

(56) References Cited

U.S. PATENT DOCUMENTS

| | | | | |
|---|---|---|---|---|
| 2012/0209417 | A1 | 8/2012 | Tokura | |
| 2012/0291648 | A1* | 11/2012 | Sheinfeld | B42F 5/00 101/483 |
| 2013/0081562 | A1* | 4/2013 | Tokura | D05B 19/12 112/78 |
| 2014/0230707 | A1 | 8/2014 | Suzuki et al. | |
| 2016/0032508 | A1* | 2/2016 | Tokura | D05B 19/08 112/102.5 |

FOREIGN PATENT DOCUMENTS

| | | | |
|---|---|---|---|
| JP | H07-265569 | A | 10/1995 |
| JP | 2005-146460 | A | 6/2005 |
| JP | 2009-201704 | A | 9/2009 |

OTHER PUBLICATIONS

U.S. Appl. No. 14/636,633, filed Mar. 3, 2015 in the name of Mitsuhiro Iida.

U.S. Appl. No. 14/805,794, filed Jul. 22, 2015 in the name of Masashi Tokura.

Aug. 27, 2015 Extended European Search Report issued in European Patent Application No. 15158901.7.

* cited by examiner

SEWING MACHINE AND NON-TRANSITORY COMPUTER-READABLE MEDIUM STORING COMPUTER-READABLE INSTRUCTIONS

CROSS-REFERENCE TO RELATED APPLICATION

This application claims priority to Japanese Patent Application No. 2014-051148, filed on Mar. 14, 2014, the content of which is hereby incorporated by reference.

BACKGROUND

The present disclosure relates to a sewing machine that is provided with an image capture portion, and to a non-transitory computer-readable medium that stores computer-readable instructions.

A sewing machine that is provided with an image capture device is known. In the sewing machine, an image (a captured image) that is described by image data that the image capture device has created is used for a background image when an embroidery pattern is positioned and edited. The captured image is also used in processing that creates embroidery data for sewing the embroidery pattern.

SUMMARY

Because the sewing machine is used in various types of environments, cases sometimes occur in which the coloring of the image that is described by the image data that the image capture portion of the sewing machine has created becomes unnatural, due to factors such as the ambient light intensity, differences in light sources, and the like.

Various embodiments of the broad principles derived herein provide a sewing machine that is capable of acquiring image data in which the image is described by appropriate colors that make the coloring appear natural, and also provide a non-transitory computer-readable medium that stores computer-readable instructions.

Exemplary embodiments provide a sewing machine that includes a needle bar, an image capture device, and a control device. On a lower end of the needle bar, a sewing needle is mounted. The image capture device captures an image of an area that includes an area below the needle bar and creates image data. The control device executes steps of causing the image capture device to create first image data, causing the image capture device to create second image data, acquiring the first image data, acquiring the second image data, and performing color-related correction on the second image data, based on the first image data.

Exemplary embodiments also provide a non-transitory computer-readable medium storing a control program for a sewing machine that is provided with an image capture device. The control program includes instructions that, when executed, cause the sewing machine to perform the steps of creating first image data by the image capture device, creating second image data by the image capture device, acquiring first image data that describe a captured image of an area that includes an area below a needle bar, acquiring second image data that describe a captured image of the area that includes the area below the needle bar, and performing color-related correction on the second image data, based on the first image data.

BRIEF DESCRIPTION OF THE DRAWINGS

Embodiments will be described below in detail with reference to the accompanying drawings in which.

DETAILED DESCRIPTION

Figure 1:
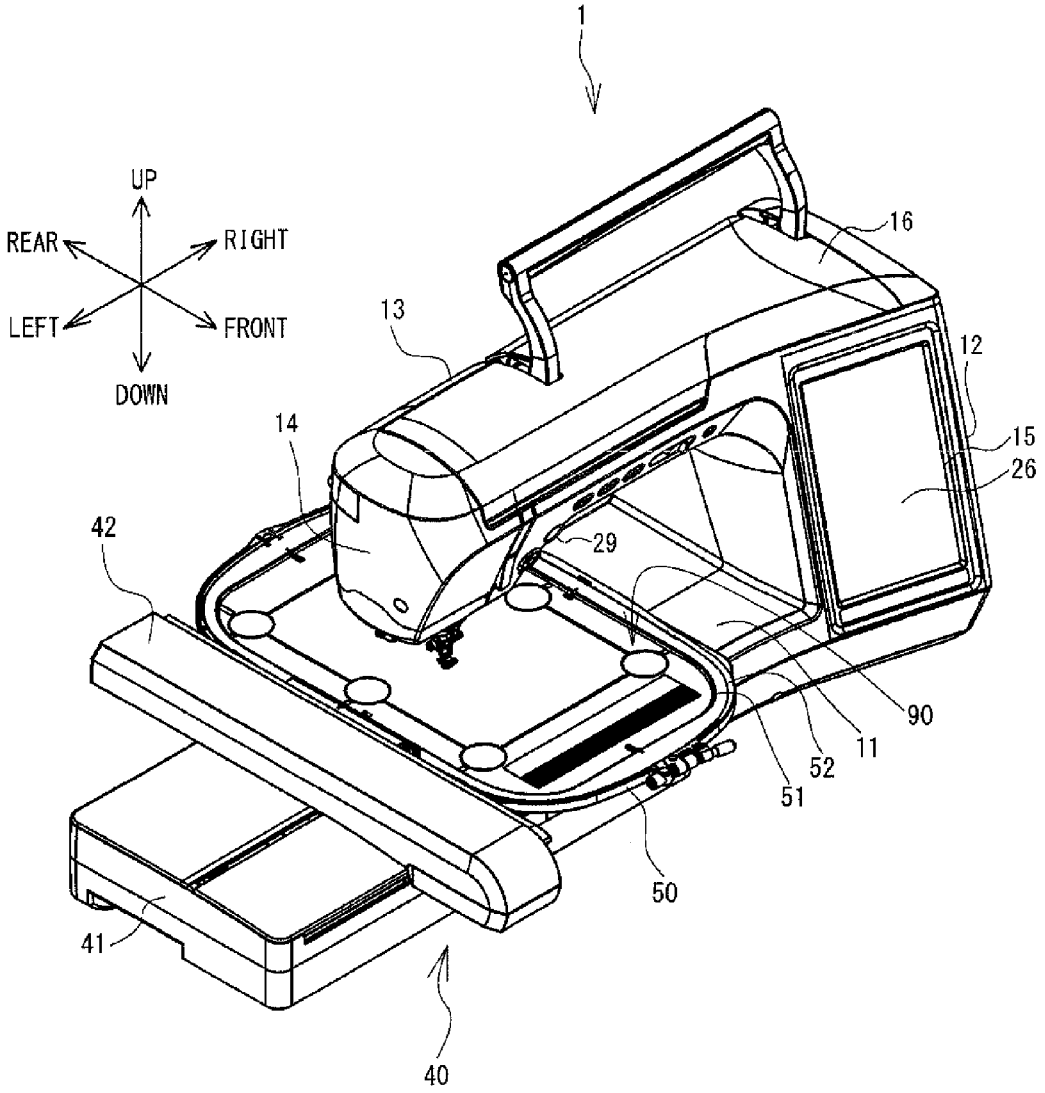
FIG. 1 is an oblique view of a sewing machine 1.

Hereinafter, embodiments will be explained with reference to the drawings. Note that the drawings are used for explaining technological features that the present disclosure can utilize. Accordingly, device configurations, flowcharts for various types of processing, and the like that are shown in the drawings are merely explanatory examples and do not serve to restrict the present disclosure to those configurations, flowcharts, and the like, unless otherwise indicated specifically. A physical configuration of a sewing machine 1 will be explained with reference to FIGS. 1 to 3. The up-down direction, the lower right side, the upper left side, the lower left side, and the upper right side in FIGS. 1 and 2 respectively define the up-down direction, the front side, the rear side, the left side, and the right side of the sewing machine 1. That is, the face of the sewing machine 1 on which is disposed a liquid crystal display 15, which will be described later, is the front face of the sewing machine 1. Lengthwise directions of a bed 11 and an arm 13 are equivalent to the left-right direction of the sewing machine 1, and the side of the sewing machine 1 on which a pillar 12 is disposed is the right side. The direction in which the pillar 12 extends is the up-down direction of the sewing machine 1.

Figure 2:
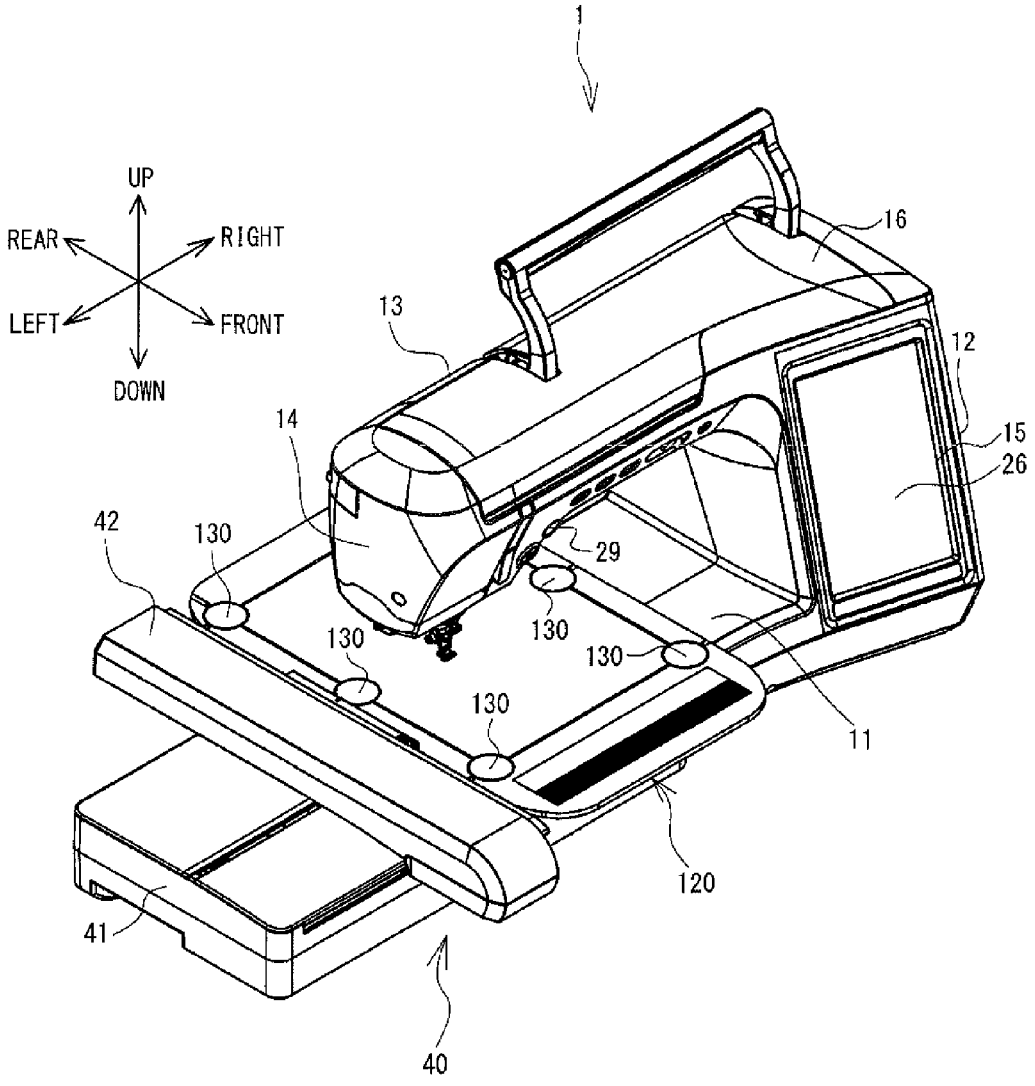
FIG. 2 is an oblique view of the sewing machine 1.

As shown in FIGS. 1 and 2, the sewing machine 1 is provided with the bed 11, the pillar 12, the arm 13, and a head 14. The bed 11 is the base portion of the sewing machine 1 and extends in the left-right direction. The pillar 12 is provided such that it extends upward from the right end of the bed 11. The arm 13 extends to the left from the upper end of the pillar 12 and faces the bed 11. The head 14 is a component that is coupled to the left end of the arm 13.

The bed 11 is provided with a needle plate 21 (refer to FIG. 3) on its top face. The needle plate 21 includes a needle hole 23 (refer to FIG. 16). A sewing workpiece (for example, a work cloth) that is not shown in the drawings is placed on the top face of the needle plate 21. A sewing needle 7, which will be described later, is able to pass through the needle hole 23. Underneath the needle plate 21 (that is, inside the bed 11), the sewing machine 1 is provided with a feed dog, a feed mechanism, a shuttle mechanism, and the like that are not shown in the drawings. During ordinary sewing that is not embroidery sewing, the feed dog is driven by the feed mechanism and moves the sewing workpiece by a specified feed amount. The shuttle mechanism entwines an upper thread (not shown in the drawings) with a lower thread (not shown in the drawings) below the needle plate 21.

The sewing machine 1 is also provided with an embroidery frame moving mechanism (hereinafter called the moving mechanism) 40. The moving mechanism 40 is capable of being mounted on and removed from the bed 11 of the sewing machine 1. FIGS. 1 and 2 show a state in which the moving mechanism 40 has been mounted on the sewing machine 1. When the moving mechanism 40 is mounted on the sewing machine 1, the moving mechanism 40 and the sewing machine 1 are electrically connected. The moving mechanism 40 is provided with a body portion 41 and a carriage 42. The carriage 42 is provided on the top side of the body portion 41. The carriage 42 has a rectangular shape whose long axis extends in the front-rear direction. The carriage 42 is provided with a frame holder (not shown in the drawings), a Y axis moving mechanism (not shown in the drawings), and a Y axis motor 84 (refer to FIG. 12). The frame holder is provided on the right side face of the carriage 42. One embroidery frame or one holder member that has been selected from among a plurality of types of embroidery frames and holder members of different sizes and shapes can be mounted on the frame holder. The plurality of types of the embroidery frames and holder members will be described later. The Y axis moving mechanism moves the frame holder in the front-rear direction (the Y axis direction). The Y axis motor 84 drives the Y axis moving mechanism.

The body portion 41 is provided with an X axis moving mechanism (not shown in the drawings) and an X axis motor 83 (refer to FIG. 12) in its interior. The X axis moving mechanism moves the carriage 42 in the left-right direction (the X axis direction). The X axis motor 83 drives the X axis moving mechanism. The moving mechanism 40 is capable of moving the one of the embroidery frame and the holder member that is mounted on the carriage 42 (the frame holder) to a position that is indicated by an XY coordinate system (an embroidery coordinate system) that is specific to the sewing machine 1. In the embroidery coordinate system, for example, the rightward direction, the leftward direction, the forward direction, and the rearward direction in the sewing machine 1 are equivalent to a positive X axis direction, a negative X axis direction, a negative Y axis direction, and a positive Y axis direction.

The liquid crystal display (hereinafter called the LCD) 15 is provided on the front face of the pillar 12. An image that includes various types of items, such as commands, illustrations, setting values, messages, and the like, is displayed on the LCD 15. A touch panel 26 that can detect a pressed position is provided on the front face of the LCD 15. When a user uses a finger or a stylus pen (not shown in the drawings) to perform a pressing operation on the touch panel 26, the pressed position is detected by the touch panel 26. Based on the pressed position that was detected, a CPU 61 of the sewing machine 1 (refer to FIG. 12) recognizes the item in the image that was selected. Hereinafter, the pressing operation on the touch panel 26 by the user will be called a panel operation. By performing a panel operation, the user can select a pattern to be sewn, a command to be executed, and the like. The pillar 12 is provided with a sewing machine motor 81 (refer to FIG. 12) in its interior.

A cover 16 that can be opened and closed is provided in the upper part of the arm 13. The cover 16 is in a closed state in FIGS. 1 and 2. A spool containing portion (not shown in the drawings) is provided under the cover 16, that is, in the interior of the arm 13. The spool containing portion is able to contain a thread spool (not shown in the drawings) on which the upper thread is wound. A drive shaft (not shown in the drawings) that extends in the left-right direction is provided in the interior of the aim 13. The drive shaft is rotationally driven by the sewing machine motor 81. Various types of switches that include a start/stop switch 29 are provided in the lower left portion of the front face of the arm 13. The start/stop switch 29 starts and stops operation of the sewing machine 1, that is, it is used for inputting commands to start and stop sewing.

Figure 3:
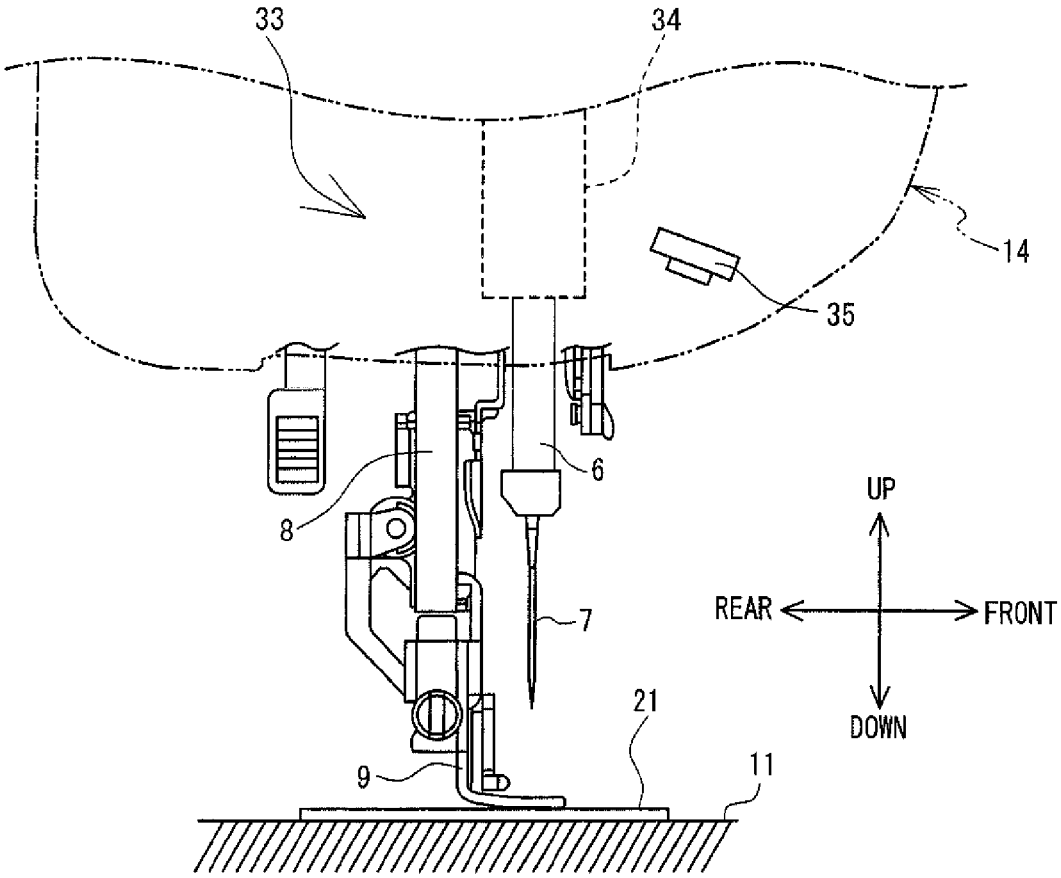
FIG. 3 is an explanatory figure that shows a configuration of a lower end portion of a head 14.

As shown in FIG. 3, a needle bar 6, a presser bar 8, a needle bar up-down drive mechanism 34, and the like are provided in the head 14. The needle bar 6 and the presser bar 8 extend downward from a lower end portion of the head 14. The sewing needle 7 is removably mounted on the lower end of the needle bar 6. A presser foot 9 is removably attached to the lower end of the presser bar 8. The needle bar 6 is provided on lower end of the needle bar up-down drive mechanism 34. The needle bar up-down drive mechanism 34 drives the needle bar 6 up and down in accordance with the rotation of the drive shaft. The needle bar 6, the needle bar up-down drive mechanism 34, and the sewing machine motor 81 (refer to FIG. 12) are provided in the sewing machine 1 as a sewing portion 33.

An image sensor 35 is provided in the interior of the head 14. The image sensor 35 is a known complementary metal oxide semiconductor (CMOS) image sensor, for example. The image sensor 35 is disposed such that it can capture an image of an area that includes the area below the needle bar 6, and it is capable of creating image data. The image data that the image sensor 35 outputs are stored in a specified storage area of a RAM 63 (refer to FIG. 12). The relationship between a coordinate system for the image that is described by the image data that the image sensor 35 has created and a coordinate system for the whole of space (hereinafter called the world coordinate system) is established in advance by parameters that are stored in a flash memory 64. The relationship between the world coordinate system and the embroidery coordinate system is established in advance by parameters that are stored in the flash memory 64 (refer to FIG. 12). Accordingly, the sewing machine 1 is capable of performing processing that specifies coordinates in the embroidery coordinate system based on the image data.

The image sensor 35 in the present embodiment has a function that creates the image data with the white balance corrected. More specifically, the image sensor 35 has an auto white balance function (hereinafter called the AWB) and a manual white balance function (hereinafter called the MWB). The AWB is a function that performs color temperature correction on the image data using determined white balance values (hereinafter called determined WB values) that are determined based on color information in the image data. The MWB is a function that performs color temperature correction on the image data using set white balance values (hereinafter called set WB values). The set WB values are white balance values (hereinafter called WB values) that are set by the CPU 61, which will be described later. The color information is information that describes color. In the present embodiment, the color information is expressed in the form of gradation values (numerical values from 0 to 255) for the three primary colors red (R), green (G), and blue (B).

The plurality of types of the embroidery frames and holder members that can be mounted on the moving mechanism 40 will be explained. The embroidery frame includes a first frame member and a second frame member, and it can hold the sewing workpiece using the first frame member and the second frame member. Each one of the first frame member and the second frame member is a frame-shaped member. The embroidery frame is configured such that stitches can be formed by the sewing portion 33 in a sewing-enabled area that is defined on the inner side the embroidery frame. The holder member is capable of holding an object of image capture by the image sensor 35. In some cases, the sewing workpiece is the object of image capture, so the embroidery frame is included in the holder member.

Figure 5:
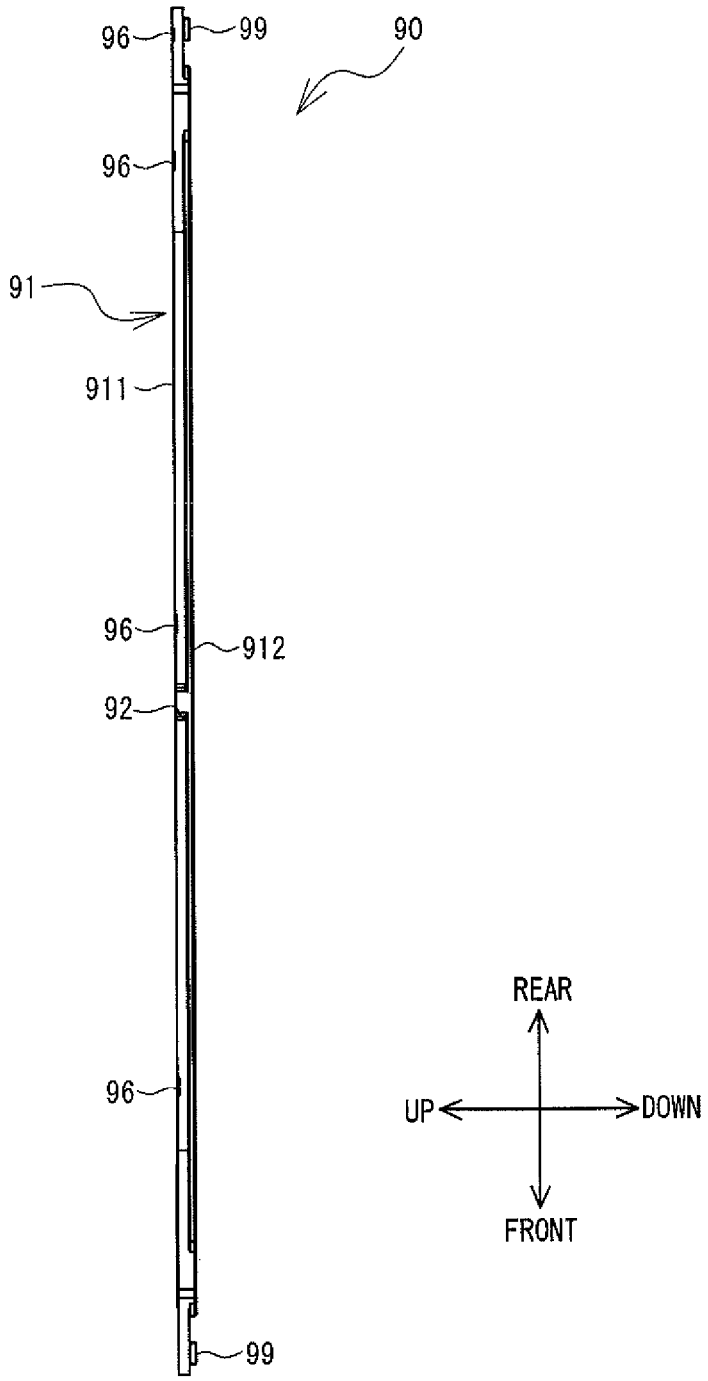
FIG. 5 is a right side view of the holder plate 90.
Figure 6:
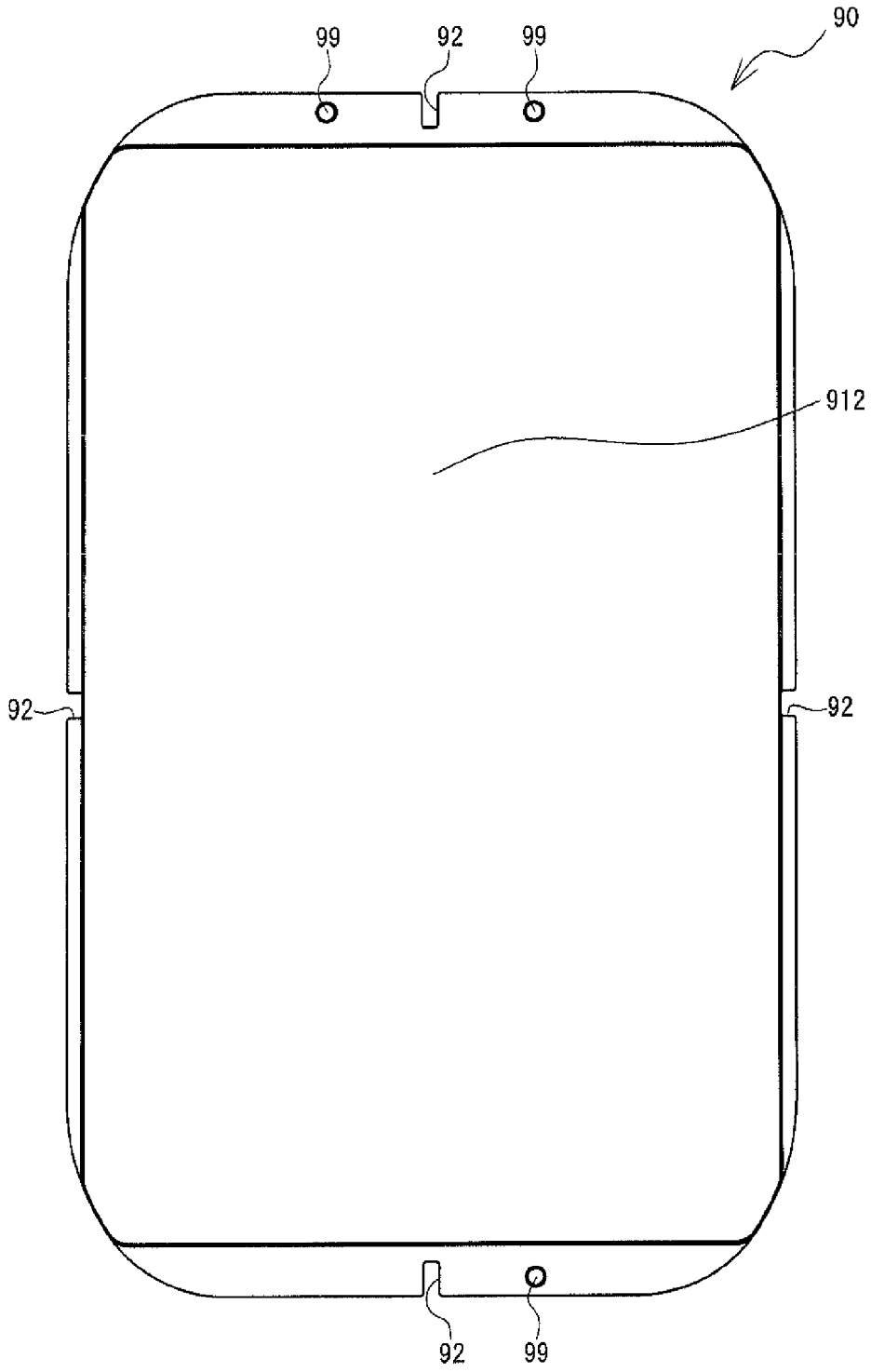
FIG. 6 is a bottom view of the holder plate 90.
Figure 7:
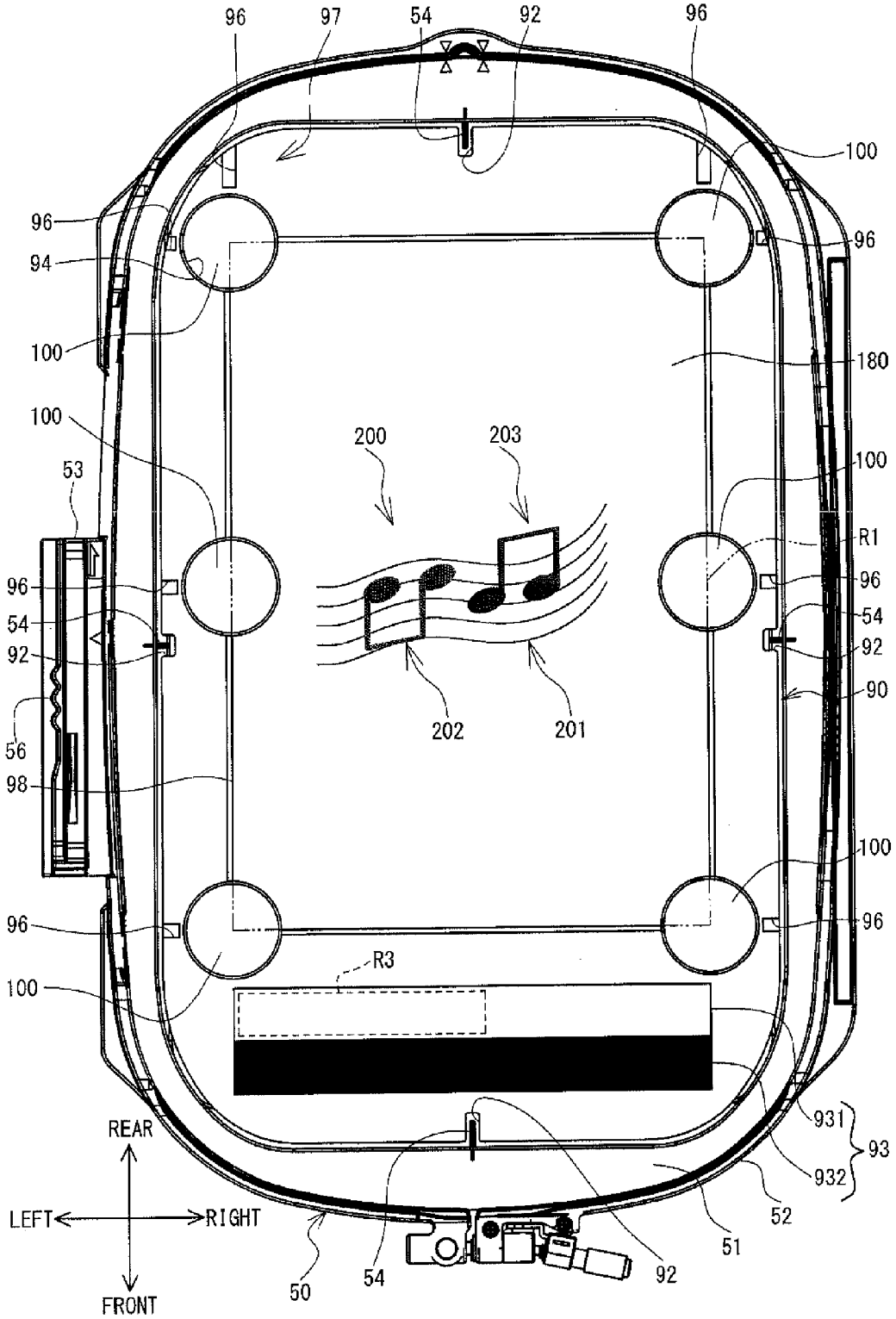
FIG. 7 is a plan view of an embroidery frame 50 to which the holder plate 90 has been attached.
Figure 8:
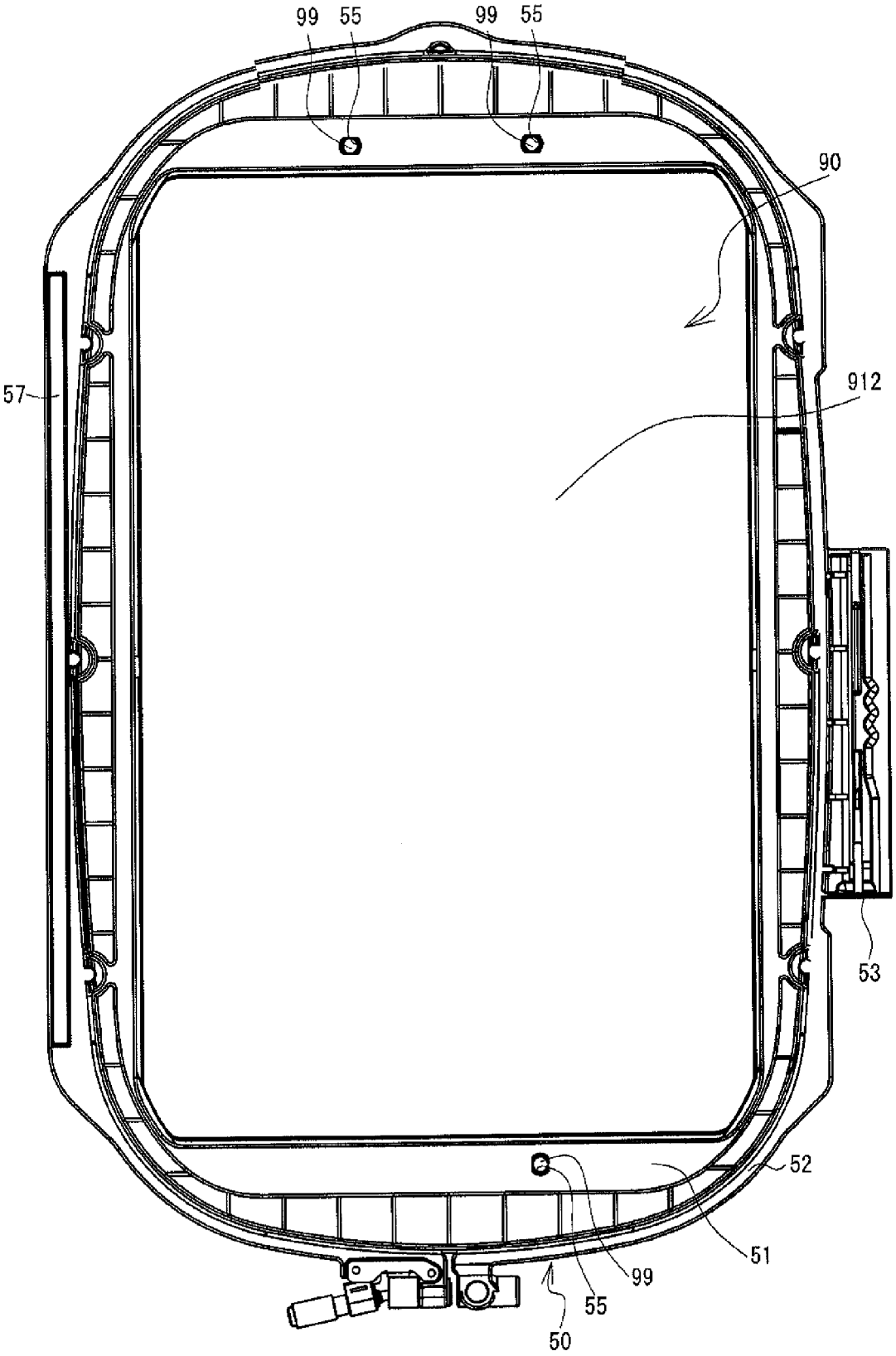
FIG. 8 is a bottom view of the embroidery frame 50 to which the holder plate 90 has been attached.

An embroidery frame 50 that can be mounted on the moving mechanism 40 and a holder plate 90 that can be mounted on the embroidery frame 50 will be explained with reference to FIG. 1 and FIGS. 4 to 8. The left-right direction, the top side, and the bottom side in FIGS. 4 and 7 respectively define the left-right direction, the rear side, and the front side of the embroidery frame 50 and the holder plate 90. The holder plate 90 is a rectangular plate member whose long axis extends in the front-rear direction in a plan view. In other words, the short side direction of the holder plate 90 is the left-right direction. The long side direction of the holder plate 90 is the front-rear direction of the holder plate 90. The side of the holder plate 90 on which a color reference member 93 that will be described later is provided is the front side of the holder plate 90. The embroidery frame 50 of which an example is shown in FIG. 1 includes an inner frame 51 and an outer frame 52 and is an embroidery frame of a known configuration that holds the sewing workpiece (not shown in the drawings) by using the inner frame 51 and the outer frame 52 to clamp it. As shown in FIGS. 7 and 8, the embroidery frame 50 is provided with a mounting portion 53, four engaging portions 54, and three engagement holes 55. The mounting portion 53 is configured such that it can be removably mounted on the moving mechanism 40 of the sewing machine 1. In the present embodiment, a detected portion 56 is provided on the mounting portion 53, as shown in FIG. 7. The detected portion 56 has a shape that is particular to the type of the embroidery frame 50. In a case where the embroidery frame 50 is mounted on the moving mechanism 40, the sewing machine 1 is able to specify the type of the embroidery frame 50 based on the shape of the detected portion 56 of the mounting portion 53, which is detected by a detector 36 (refer to FIG. 12) that will be described later. The four engaging portions 54 and the three engagement holes 55 engage with the holder plate 90 that is mounted on the embroidery frame 50.

Figure 4:
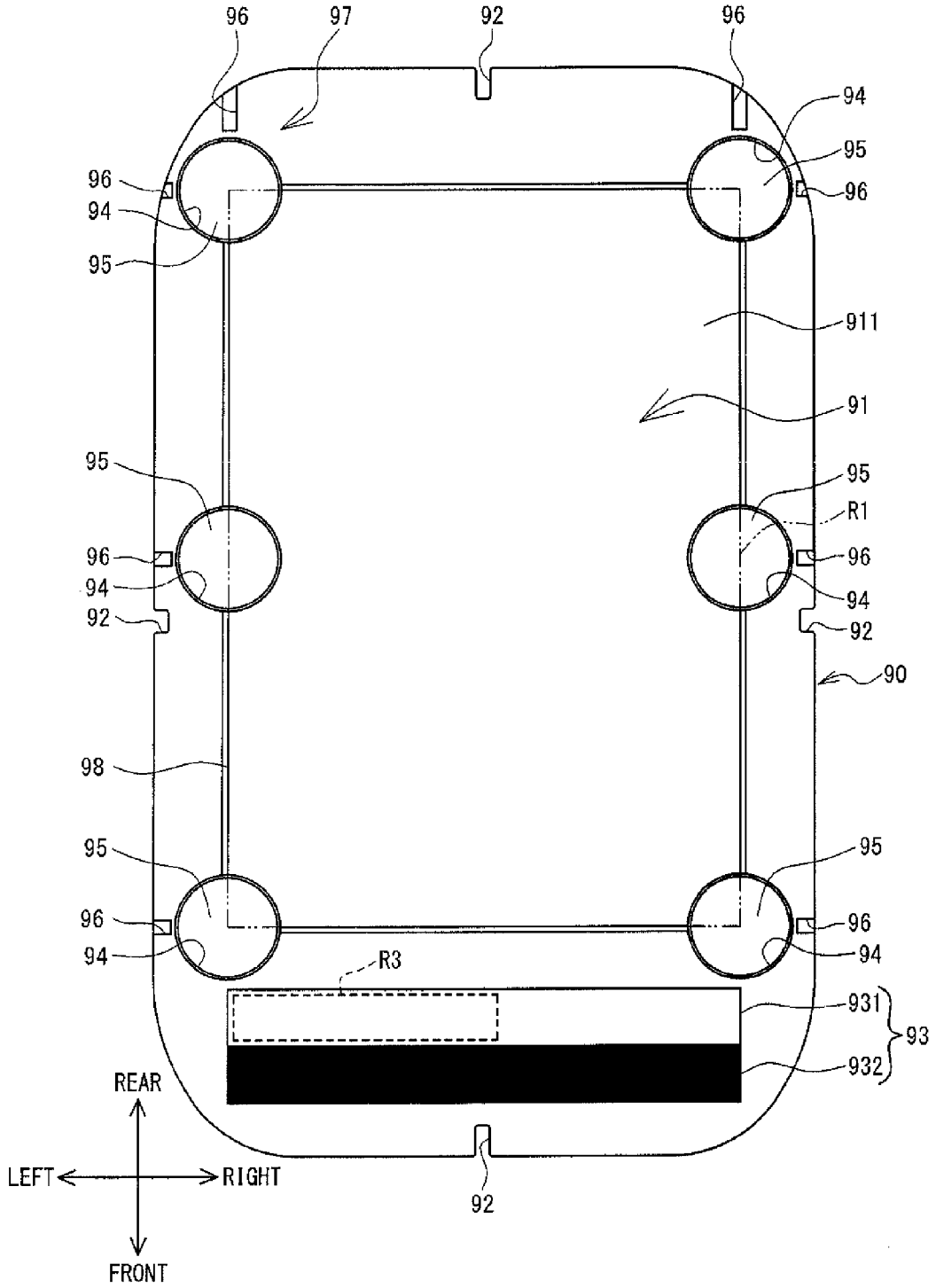
FIG. 4 is a plan view of a holder plate 90.

As shown in FIGS. 1, 7, and 8, the holder plate 90 can be mounted on the embroidery frame 50. The holder plate 90 is used in a case where an image of a sheet-shaped object, for example, will be captured by the image sensor 35. The sheet-shaped object may be a paper, a work cloth, or a resin sheet, for example. As shown in FIGS. 4 to 6, the holder plate 90 is mainly provided with a planar portion 91, four engaging portions 92, three engaging portions 99, the color reference member 93, six magnetic bodies 95, an indicator portion 97, a base line 98, and six magnets 100 (refer to FIG. 7). To facilitate the explanation, the magnets 100 are not shown in FIGS. 4 and 5. The planar portion 91 has a surface 911 that is planar. As shown in FIGS. 5 and 6, the planar portion 91 in the present embodiment has a surface 912 that is also planar on the opposite side from the surface 911. The four engaging portions 92 and the three engaging portions 99 are able to engage with the embroidery frame 50 that is mounted on the sewing machine 1. More specifically, the four engaging portions 92 are notches that are provided in central portions of each of the four sides of the rectangular holder plate 90 and that extend toward the center of the holder plate 90. Each one of the three engaging portions 99 is a protruding portion that is circular in a bottom view and that projects downward from the bottom face of the holder plate 90. Two of the three engaging portions 99 are provided on the front side of the bottom face of the holder plate 90, and one of the three engaging portions 99 is provided on the rear side of the bottom face of the holder plate 90.

The color reference member 93 is a member that serves as a color reference. The color reference member 93 includes a white color reference member 931 that serves as a reference for the color white and a black color reference member 932 that serves as a reference for the color black. In the present embodiment, each one of the white color reference member 931 and the black color reference member 932 is a known reflective plate whose surface is planar. The color reference member 93 may be formed by printing coatings of the specified colors on the planar portion 91, and may also be formed by affixing to the planar portion 91 a reflective tape material of the specified colors. Each one of the white color reference member 931 and the black color reference member 932 lies on the same plane as the surface 911 of the planar portion 91 and is positioned to the outside of an image capture object range R1. More specifically, each one of the white color reference member 931 and the black color reference member 932 is provided such that it extends in the short side direction (the left-right direction) of the holder plate 90 at one end (the front end) of the holder plate 90 in the long side direction. Each one of the white color reference member 931 and the black color reference member 932 is provided within an image capture enabled range for the image sensor 35. The image capture enabled range for the image sensor 35 is determined by an image capture range of the image sensor 35, a movement enabled range for the moving mechanism 40, the size of the embroidery frame or the holder member, and the like. The image capture object range R1 is a rectangular range that is the object of image capture by the image sensor 35 and is the range that is indicated by dashed-two dotted lines in FIGS. 4 and 7. The image capture object range R1 includes the center portion of the surface 911 of the planar portion 91. In the present embodiment, the image capture object range R1 is set by the sewing machine 1 within the image capture enabled range for the image sensor 35, in accordance with the types of the embroidery frame and the holder member, based on data that are stored in the flash memory 64.

In the present embodiment, each one of the white color reference member 931 and the black color reference member 932 is rectangular, with a smaller surface area than that of the image capture object range R1, and they are disposed adjacent to one another. The lengths of the white color reference member 931 and the black color reference member 932 in the long side direction (the left-right direction) are the same as the length of the image capture object range R1 in the short side direction (the left-right direction). The image capture object range R1 is larger than the image capture range within which the image sensor 35 can capture an image in one round of image capture. Therefore, in order to create image data that describe the entire image capture object range R1, the CPU 61, which will be described later, causes the image sensor 35 to capture images of the image capture object range R1 sequentially while causing the moving mechanism 40 to move the embroidery frame 50.

In contrast, the lengths of the white color reference member 931 and the black color reference member 932 in the short side direction (the front-rear direction) are lengths that are set by taking into consideration a unit image capture range R3 for the image sensor 35. The unit image capture range R3 is a range, within the image capture range, that is used for image processing, and it is a rectangular range that is indicated by broken lines in FIG. 4. The length of the unit image capture range R3 in the left-right direction is slightly longer than half the length of the image capture object range R1 in the left-right direction. Note that the unit image capture range R3 is a portion of the image capture range, but it may also be the same size as the image capture range.

Each one of the six magnetic bodies 95 is an iron plate that is circular in a plan view. Each of the magnetic bodies 95 is disposed inside a recessed portion 94 that is provided in the surface 911 and is circular in a plan view, and is embedded in the planar portion 91. In other words, the top face of each of the magnetic bodies 95 is either even with the surface 911 or slightly below the surface 911 and does not protrude above the surface 911. In the present embodiment, each one of the six magnetic bodies 95 is disposed in a position that coincides with a portion of the boundary of the image capture object range R1 within the surface 911 of the planar portion 91. Four of the six magnetic bodies 95 are disposed at the four corners of the rectangular image capture object range R1. The remaining two of the six magnetic bodies 95 are disposed in the centers of the two long sides of the rectangular image capture object range R1. As shown in FIG. 7, the holder plate 90 is provided with the six magnets 100, which correspond to the individual magnetic bodies 95. A sheet-shaped object, such as a rectangular paper 180 on which a FIG. 200 is drawn, for example, can be affixed to the holder plate 90 by the six sets of the magnetic bodies 95 and the magnets 100. That is, the six sets of the magnetic bodies 95 and the magnets 100 are configured to affix an object that has been placed on the planar portion 91.

The indicator portion 97 is provided in at least the perimeter portion of the planar portion 91. In the present embodiment, the indicator portion 97 includes eight indicators 96 that are positioned to the outside of the magnetic bodies 95 (in the same plane as the surface 911 and farther from the center of the holder plate 90 than are the magnetic bodies 95). Each one of the indicators 96 indicates the positions of the magnetic bodies 95 that are embedded in the planar portion 91. Two of the eight indicators 96 are recessed portions that are provided such that they extend from one edge (the rear edge) toward the other edge (the front edge) in the long side direction of the holder plate 90, and they indicate the positions of the magnetic bodies 95 in the long side direction of the holder plate 90. Three of the eight indicators 96 are recessed portions that are provided such that they extend from one edge (the left edge) toward the other edge (the right edge) in the short side direction of the holder plate 90, and they indicate the positions of the magnetic bodies 95 in the short side direction of the holder plate 90. Three of the eight indicators 96 are recessed portions that are provided such that they extend from one edge (the right edge) toward the other edge (the left edge) in the short side direction of the holder plate 90, and they indicate the positions of the magnetic bodies 95 in the short side direction of the holder plate 90. Because the indicator portion 97 is positioned to the outside of the magnetic bodies 95, cases occur in which, depending on the size of the sheet-shaped object, the indicators 96 are not covered by the sheet-shaped object, even if the magnetic bodies 95 are covered by the sheet-shaped object. In these cases, the user is able to specify the positions of the six magnetic bodies 95 based on the positions of the indicators 96 that indicate the positions in the short side direction of the holder plate 90 and on the positions of the indicators 96 that indicate the positions in the long side direction of the holder plate 90.

The base line 98 is a guide for placing an object on the surface 911 of the planar portion 91. In the present embodiment, the base line 98 is a straight line segment that extends along the outline of the image capture object range R1.

As shown in FIG. 7, when the holder plate 90 has been mounted on the embroidery frame 50, the four engaging portions 92 engage with the corresponding four protruding engaging portions 54 of the embroidery frame 50. As shown in FIG. 8, when the holder plate 90 has been mounted on the embroidery frame 50, the three engaging portions 99 engage with the corresponding three engagement holes 55 of the embroidery frame 50, which are through-holes in the up-down direction and are circular in a bottom view. The holder plate 90 is positioned in relation to the embroidery frame 50 and locked in place by these engagements. When the embroidery frame 50 on which the holder plate 90 has been mounted is mounted on the moving mechanism 40, the surface 911 of the holder plate 90 is approximately parallel to the bed 11. The planar portion 91 is disposed on the top side of the needle plate 21 and below the needle bar 6 and the presser foot 9. Furthermore, as shown in FIG. 8, a rectangular sliding sheet 57 whose long axis extends in the long side direction of the embroidery frame 50 is provided on the underside of the right edge of the outer frame 52 of the embroidery frame 50. The sliding sheet 57 is a sheet member that has been processed to give its surface a low coefficient of friction. The sliding sheet 57 is provided such that it protrudes slightly from the surface of the underside of the outer frame 52. The amount that the sliding sheet 57 protrudes is determined by taking into consideration the distance between the embroidery frame 50, which is mounted on the moving mechanism 40, and one of the bed 11 and the needle plate 21. Therefore, when the embroidery frame 50 has been mounted on the moving mechanism 40, the sliding sheet 57 is in a state of contact with the top face of the one of the bed 11 and the needle plate 21. When the embroidery frame 50 has been mounted on the moving mechanism 40, one long side of the embroidery frame 50 is supported by the mounting portion 53, and the other long side of the embroidery frame 50 is supported by the sliding sheet 57. The embroidery frame 50 can more easily keep horizontal the surface of the planar portion 91 that is mounted on the embroidery frame 50 than would be possible if the sliding sheet 57 were not provided on the embroidery frame 50. When the moving mechanism 40 moves the embroidery frame 50, the moving mechanism 40 is able to move the embroidery frame 50 smoothly in a state of low friction resistance, because the sliding sheet 57 moves while in contact with the top face of the one of the bed 11 and the needle plate 21.

Figure 9:
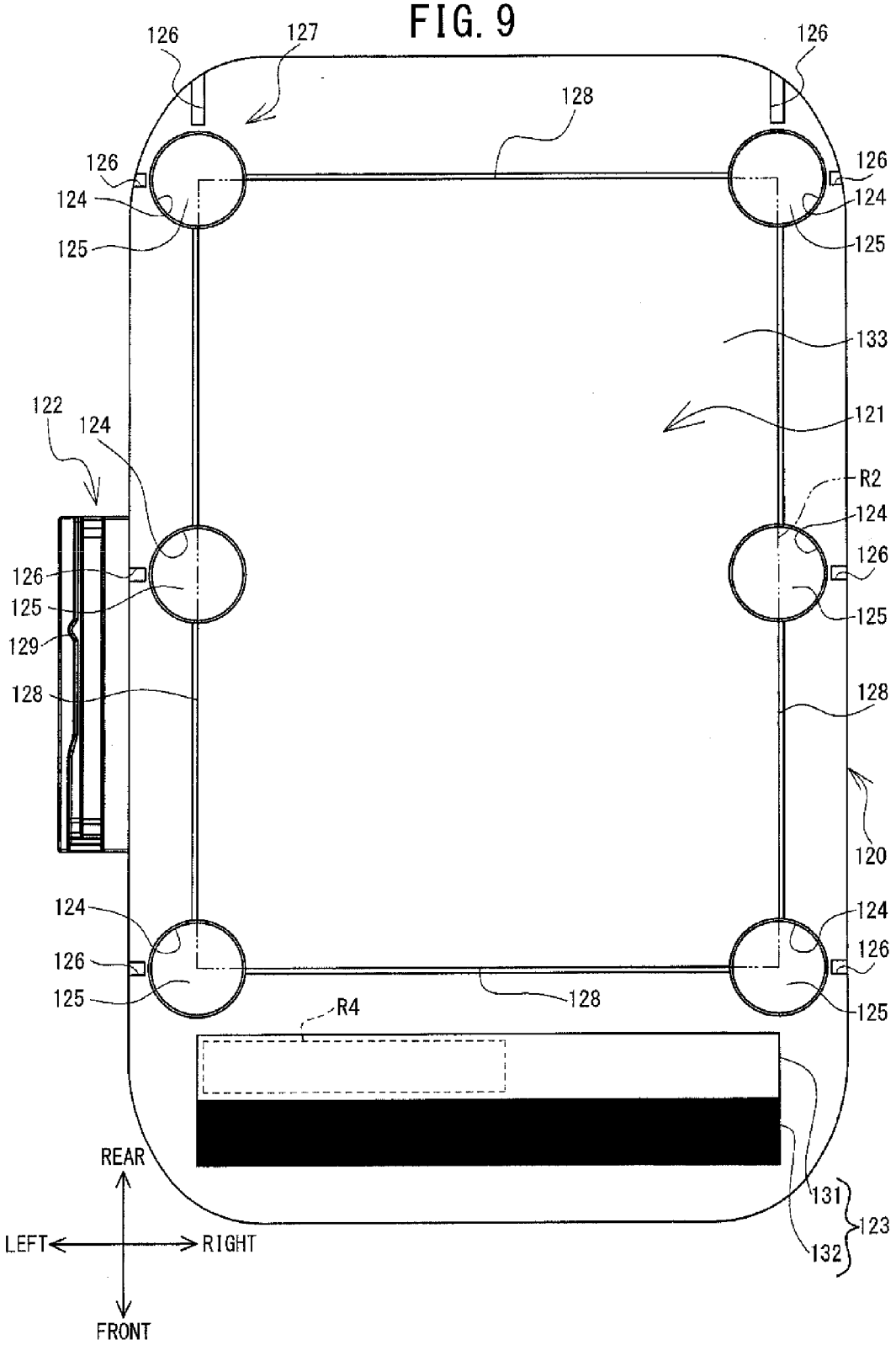
FIG. 9 is a plan view of a holder member 120.
Figure 10:
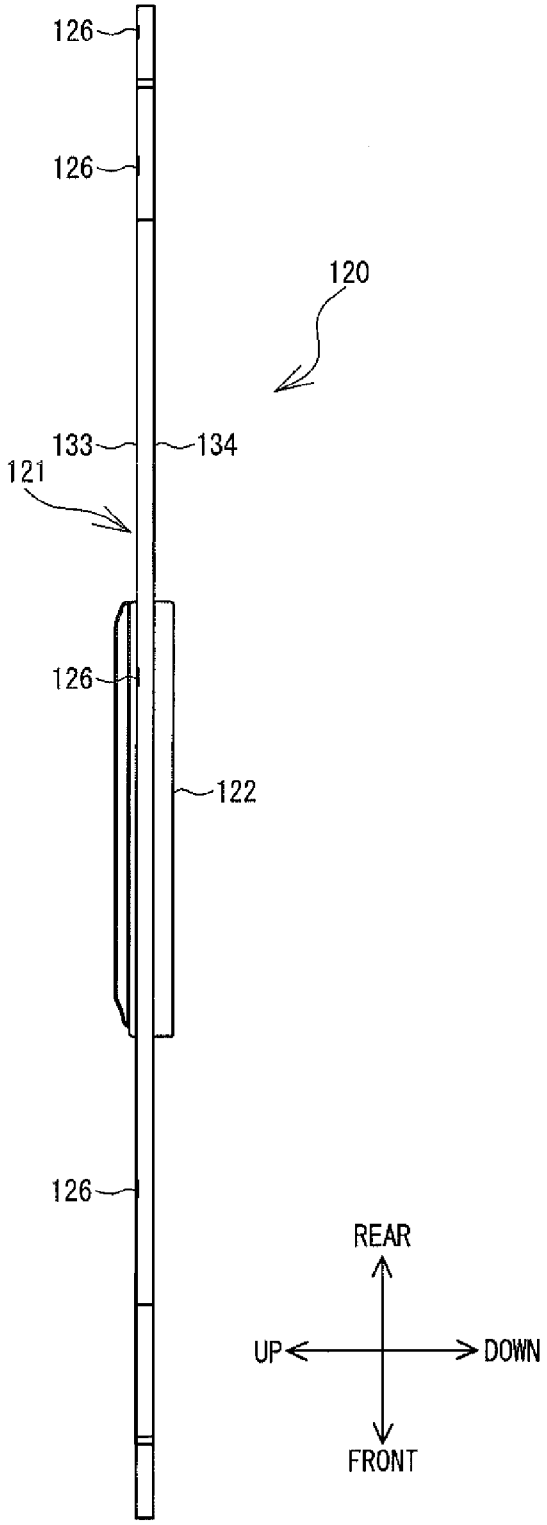
FIG. 10 is a right side view of the holder member 120.
Figure 11:
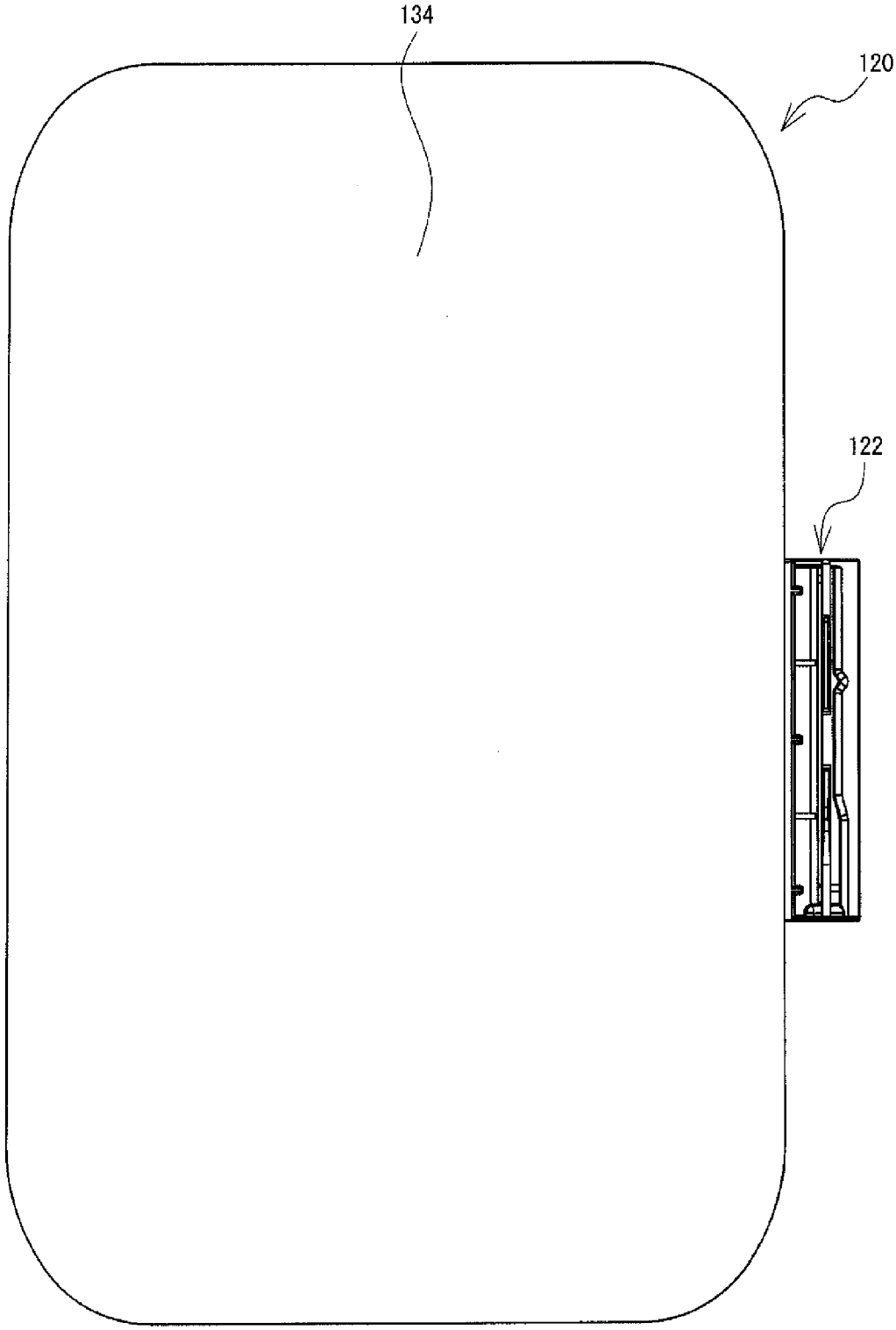
FIG. 11 is a bottom view of the holder member 120.

A holder member 120 that can be mounted on the moving mechanism 40 will be explained with reference to FIGS. 9 to 11. The left-right direction, the top side, and the bottom side in FIG. 9 respectively define the left-right direction, the rear side, and the front side of the holder member 120. The holder member 120 is a rectangular plate member whose long axis extends in the front-rear direction in a plan view. In other words, the short side direction of the holder member 120 is the left-right direction. The side of the holder member 120 on which a mounting portion 122 that will be described later is provided is the left side of the holder member 120. The long side direction of the holder member 120 is the front-rear direction of the holder member 120. The side of the holder member 120 on which a color reference member 123 that will be described later is provided is the front side of the holder member 120. The holder member 120 of which an example is shown in FIGS. 9 to 11 is used in a case where an image of a sheet-shaped object, for example, will be captured by the image sensor 35. The configuration of the holder member 120 is similar to the configuration of the holder plate 90, so explanations of elements that are the same will be simplified. Note that the configuration of the holder member 120 omits the sliding sheet on the underside.

As shown in FIGS. 9 to 11, the holder member 120 is mainly provided with a planar portion 121, the mounting portion 122, the color reference member 123, six magnetic bodies 125, an indicator portion 127, a base line 128, and six magnets 130 (refer to FIG. 2). The planar portion 121 has a surface 133 that is planar and has a rectangular shape in a plan view. As shown in FIGS. 10 and 11, the planar portion 121 in the present embodiment has a surface 134 that is also planar on the opposite side from the surface 133. The mounting portion 122 is provided approximately in the center of one long side (the left side) of the perimeter portion of the planar portion 121 and is a rectangular component in a plan view whose long axis extends in the long side direction of the planar portion 121. The mounting portion 122 supports the planar portion 121 and is configured such that it can be removably mounted on the moving mechanism 40 of the sewing machine 1. In the present embodiment, a detected portion 129 is provided on the mounting portion 122. The detected portion 129 has a shape that is particular to the type of the holder member 120 and that is different from the shape of the detected portion 56 that is provided on the mounting portion 53 of the embroidery frame 50. Therefore, when the holder member 120 has been mounted on the moving mechanism 40, the sewing machine 1 is able to specify that the holder member 120 has been mounted, based on the shape of the detected portion 129 that is detected by the detector 36, which will be described later.

The color reference member 123 is a member that serves as a color reference. The color reference member 123 is located in the perimeter portion of the planar portion 121, at one end of the holder member 120 in the long side direction, to the outside (on the front side) of an image capture object range R2, which is bounded by the base line 128. In the same manner as the color reference member 93, the color reference member 123 includes a white color reference member 131 that serves as a reference for the color white and a black color reference member 132 that serves as a reference for the color black. The lengths of the white color reference member 131 and the black color reference member 132 in the long side direction (the left-right direction) are the same as the length of the image capture object range R2 in the short side direction. The image capture object range R2 is a rectangular range that is the object of image capture by the image sensor 35 and is the range that is indicated by dashed-two dotted lines in FIG. 9. The lengths of the white color reference member 131 and the black color reference member 132 in the short side direction (the front-rear direction) are lengths that are set by taking into consideration a rectangular unit image capture range R4 that is indicated by broken lines in FIG. 9. The unit image capture range R4 is a rectangular range, within the image capture range, that is used for image processing, in the same manner as the unit image capture range R3. The length of the unit image capture range R4 in the long side direction (the left-right direction) is slightly longer than half the length of the image capture object range R2 in the short side direction (the left-right direction). Note that the unit image capture range R4 is a portion of the image capture range, but it may also be the same size as the image capture range.

Each one of the six magnetic bodies 125 is an iron plate that is circular in a plan view. In the same manner as the magnetic bodies 95, each of the magnetic bodies 125 is embedded inside a recessed portion 124 that is provided in the surface 133 and is circular in a plan view. The holder member 120 is provided with the six magnets 130 (refer to FIG. 2), which respectively correspond to the magnetic bodies 125. A sheet-shaped object can be affixed to the holder member 120 by the six sets of the magnetic bodies 125 and the magnets 130. In other words, the six sets of the magnetic bodies 125 and the magnets 130 are configured such that they fix in place an object that is placed on the planar portion 121.

The indicator portion 127 is provided in at least the perimeter portion of the planar portion 121. In the same manner as the indicator portion 97, the indicator portion 127 is provided with eight indicators 126. Each one of the eight indicators 126 indicates the positions of the magnetic bodies 125 that are embedded in the planar portion 121.

The base line 128 is a guide for placing an object on the surface 133 of the planar portion 121. In the present embodiment, the base line 128 is a straight line segment that extends along the outline of the rectangular image capture object range R2. When the holder member 120 has been mounted on the moving mechanism 40, the surface 133 of the holder member 120 is approximately parallel to the bed 11. The planar portion 121 is disposed on the top side of the needle plate 21 and below the needle bar 6 and the presser foot 9.

Figure 12:
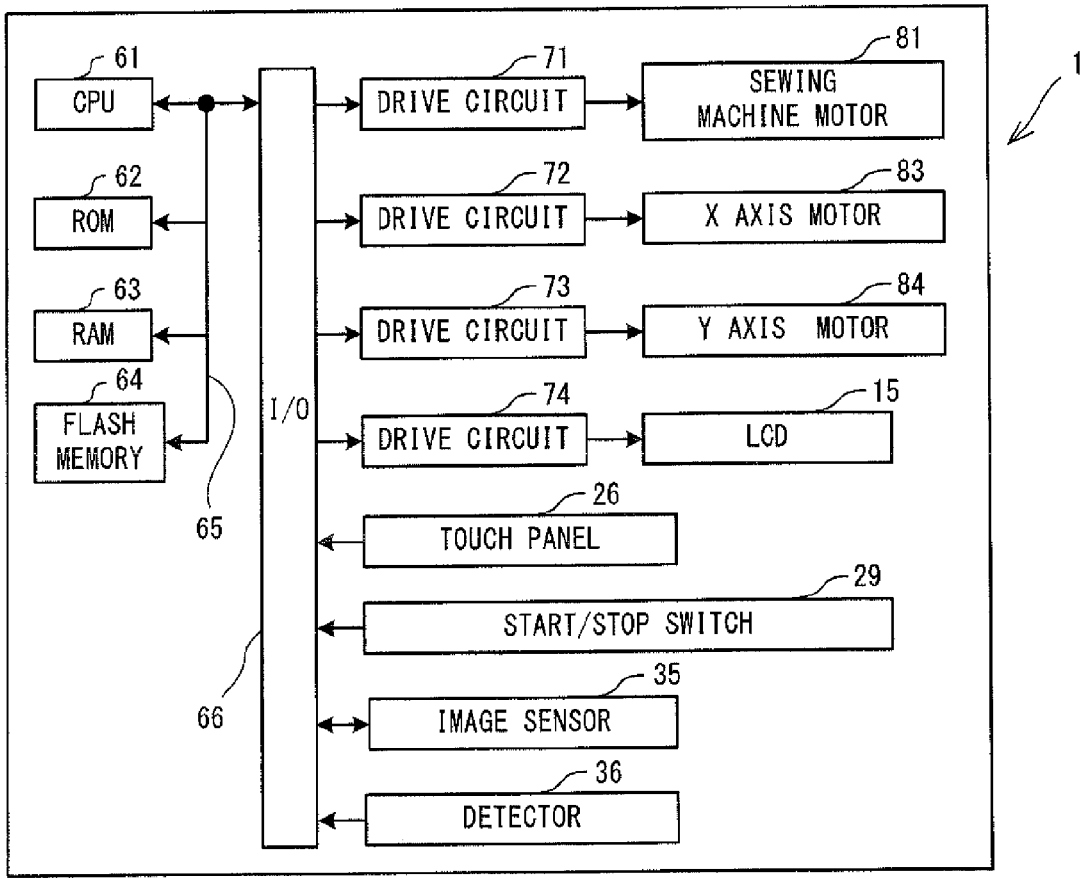
FIG. 12 is a block diagram of an electrical configuration of the sewing machine 1.

An electrical configuration of the sewing machine 1 will be explained with reference to FIG. 12. The sewing machine 1 is provided with the CPU 61 and with a ROM 62, the RAM 63, the flash memory 64, and an input/output interface (I/O) 66, each of which is connected to the CPU 61 by a bus 65.

The CPU 61 performs main control of the sewing machine 1 and, in accordance with various types of programs that are stored in the ROM 62, performs various types of computations and processing that are related to image capture and sewing. The ROM 62 is provided with a plurality of storage areas that include a program storage area, although they are not shown in the drawings. Various types of programs for operating the sewing machine 1 are stored in the program storage area. For example, among the stored programs is a program that causes the sewing machine 1 to perform image capture and sewing processing, which will be described later.

Storage areas that store computation results from computational processing by the CPU 61 are provided in the RAM 63 as necessary. Various types of parameters and the like for the sewing machine 1 to perform various types of processing, including the image capture and sewing processing that will be described later, are stored in the flash memory 64. Drive circuits 71 to 74, the touch panel 26, the start/stop switch 29, the image sensor 35, and the detector 36 are connected to the I/O 66. The detector 36 is configured to detect the type of the embroidery frame or the holder member that is mounted on the moving mechanism 40, and to output a detection result.

The sewing machine motor 81 is connected to the drive circuit 71. The drive circuit 71 drives the sewing machine motor 81 in accordance with a control signal from the CPU 61. As the sewing machine motor 81 is driven, the needle bar up-down drive mechanism 34 (refer to FIG. 3) is driven through the drive shaft (not shown in the drawings) of the sewing machine 1, and the needle bar 6 is moved up and down. The X axis motor 83 is connected to the drive circuit 72. The Y axis motor 84 is connected to the drive circuit 73. The drive circuits 72 and 73 respectively drive the X axis motor 83 and the Y axis motor 84 in accordance with control signals from the CPU 61. As the X axis motor 83 and the Y axis motor 84 are driven, the embroidery frame 50 is moved in the left-right direction (the X axis direction) and the front-rear direction (the Y axis direction) by amounts that correspond to the control signals. By driving the LCD 15 in accordance with a control signal from the CPU 61, the drive circuit 74 causes the LCD 15 to display an image.

The operation of the sewing machine 1 will be explained briefly. During embroidery sewing in which the embroidery frame 50 is used, the needle bar up-down drive mechanism 34 (refer to FIG. 3) and the shuttle mechanism (not shown in the drawings) are driven in conjunction with the moving of the embroidery frame 50 in the left-right direction (the X axis direction) and the front-rear direction (the Y axis direction) by the moving mechanism 40. These operations cause an embroidery pattern to be sewn, by the sewing needle 7 that is mounted on the needle bar 6, in the sewing workpiece that is held in the embroidery frame 50. When an ordinary utility pattern that is not an embroidery pattern is sewn, the sewing is performed as the sewing workpiece is moved by the feed dog (not shown in the drawings), in a state in which the moving mechanism 40 has been removed from the bed 11.

Figure 13:
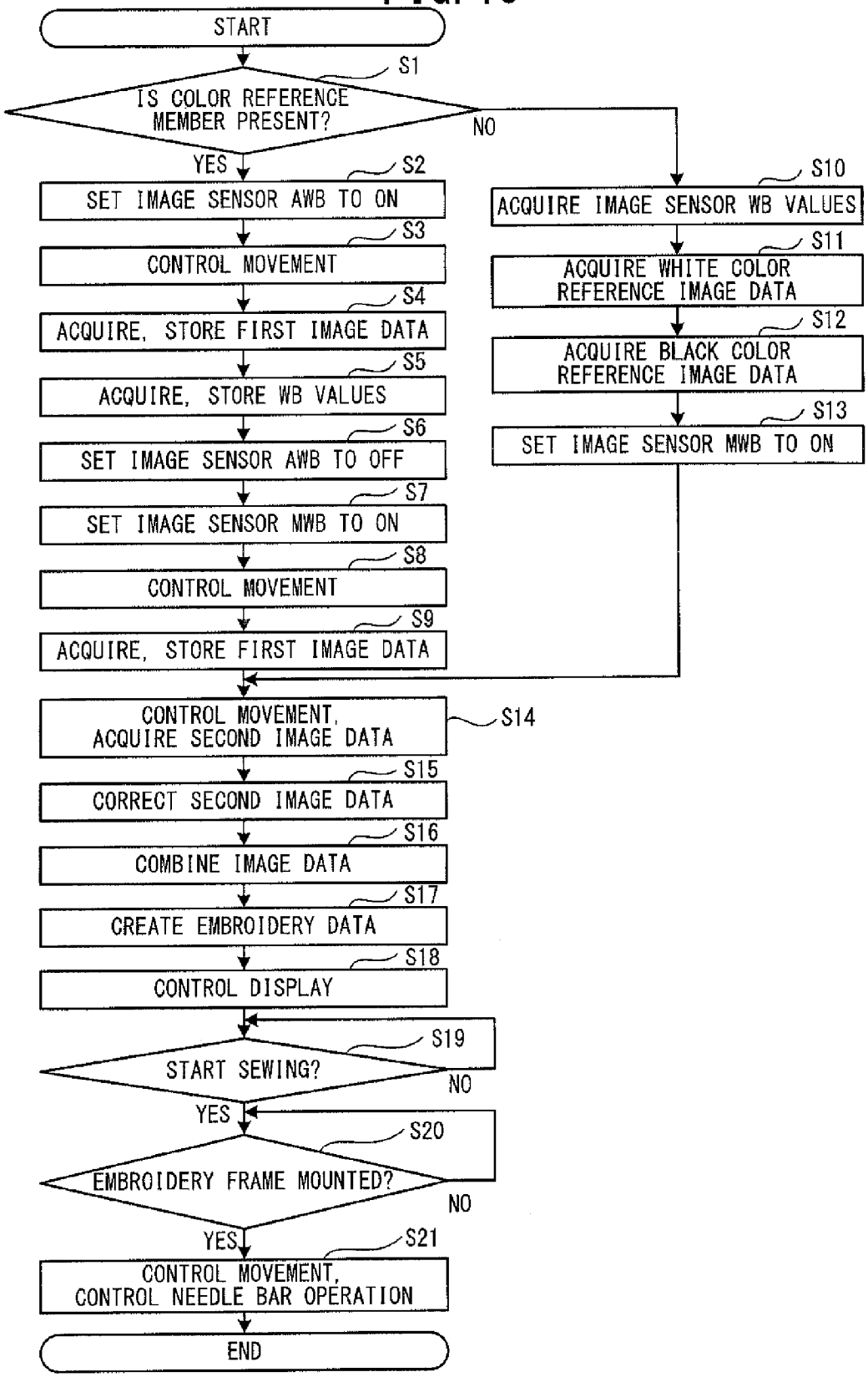
FIG. 13 is a flowchart of image capture and sewing processing.
Figure 14:
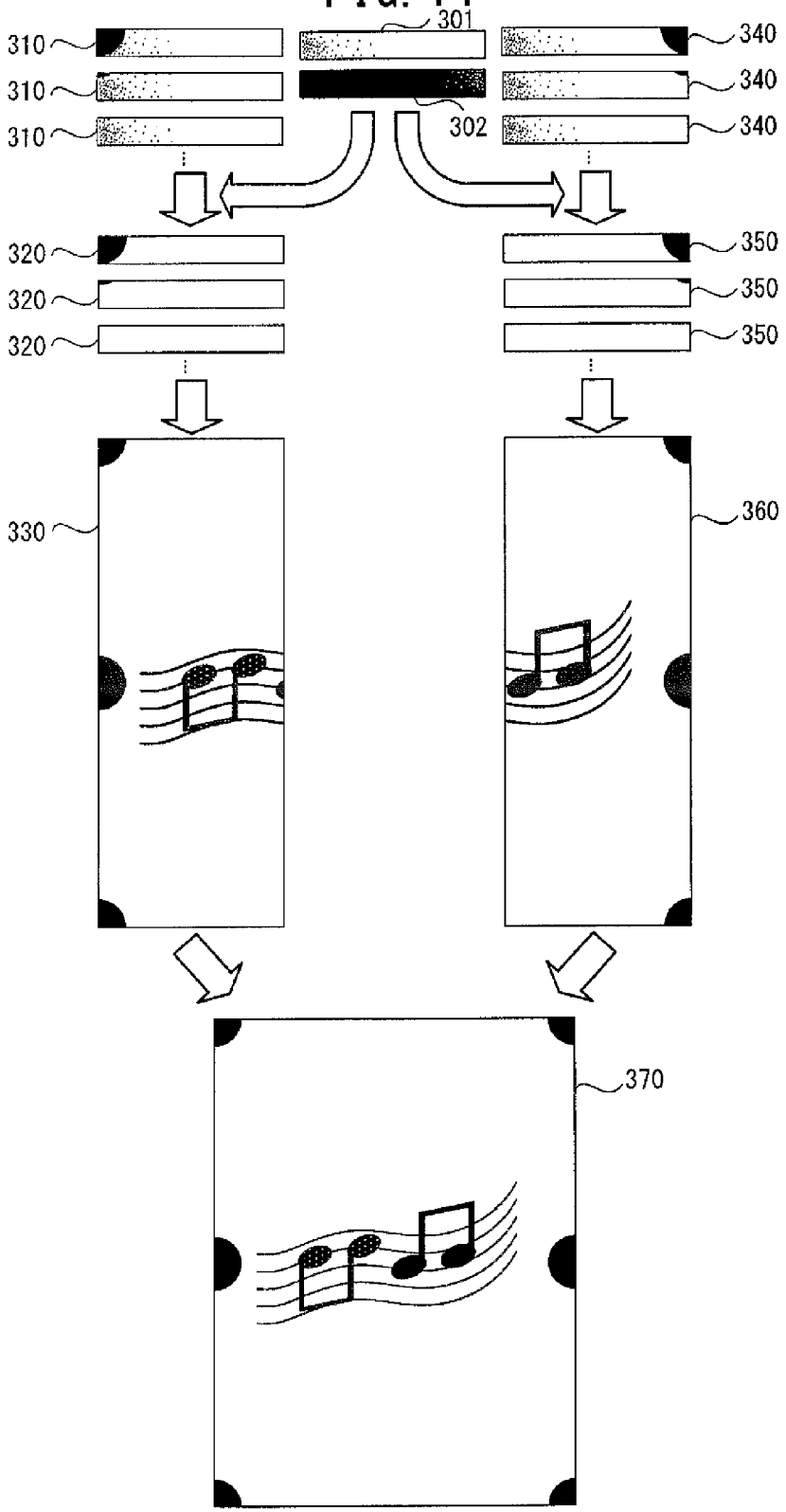
FIG. 14 is an explanatory figure that schematically shows a process, in the image capture and sewing processing in FIG. 13, by which combined image data are created that describe an image 370 of an entire image capture range.

The image capture and sewing processing will be explained with reference to FIGS. 13 and 14. In the image capture and sewing processing that is shown in FIG. 13, embroidery data are created based on image data (second image data) that are created when an image is captured of a figure that is drawn on a sheet-shaped object such as a paper or the like. In the present embodiment, the image is captured by the image sensor 35 when the sheet-shaped object is in a state of being held in one of the holder plate 90 and the holder member 120. The colors in the second image data are corrected based on image data (first image data) that are created when an image is captured of a color reference member. In the image capture and sewing processing, a plurality of stitches (a pattern) that express the figure that was drawn on the object are sewn in the sewing workpiece, based on the embroidery data that are created. The embroidery data include a sewing order and coordinate data. The coordinate data describe the positions to which the embroidery frame or the holder member is moved by the moving mechanism 40. The coordinate data in the present embodiment describe the coordinates (relative coordinates) in the embroidery coordinate system of needle drop points for sewing the pattern. The needle drop points are the points where the sewing needle 7, which is disposed directly above the needle hole 23 (refer to FIG. 16), pierces the sewing workpiece when the needle bar 6 is moved downward from above.

The embroidery data in the present embodiment include thread color data. The thread color data are data that indicate the colors of the upper threads that will form the stitches. In the image capture and sewing processing, the thread color data are determined based on color information for the figure that is described by the corrected second image data. As an example, a case will be explained in which embroidery data are created that describe the FIG. 200 that is drawn on the paper 180 that is shown in FIG. 7. As shown in FIG. 7, the FIG. 200 is a figure in which a FIG. 201 of a musical staff in a first color, a FIG. 202 of musical notes in a second color, and a FIG. 203 of musical notes in a third color are combined.

The image capture and sewing processing is started in a case where the user has used a panel operation to input a start command. When the CPU 61 detects the start command, it reads into the RAM 63 the program for performing the image capture and sewing processing, which is stored in the program storage area of the ROM 62 that is shown in FIG. 12. In accordance with the instructions that are contained in the program, the CPU 61 performs the processing at the individual steps that will hereinafter be explained. Various types of parameters that are necessary for performing the image capture and sewing processing are stored in the flash memory 64. Various types of data that are produced in the course of processing are stored in the RAM 63 as appropriate. In order to simplify the explanation, a case will be explained in which a selected one of the embroidery frame 50 and the holder member 120 can be mounted on the moving mechanism 40.

As shown in FIG. 13, in the image capture and sewing processing, the CPU 61 first determines whether a color reference member is present on a member that is mounted on the moving mechanism 40 (Step S1). In a case where the CPU 61 determines, based on a detection result from the detector 36, that the holder member 120 has been mounted, the CPU 61 determines that the color reference member is present. The CPU 61 also determines that the color reference member is present in a case where the CPU 61 determines, based on a detection result from the detector 36, that the embroidery frame 50 has been mounted, and the CPU 61 has detected that information indicating that the holder plate 90 has been mounted on the embroidery frame 50 has been input by a panel operation. In a case where the color reference member is present (YES at Step S1), the CPU 61 sets the AWB of the image sensor 35 to on (Step S2). In the present embodiment, in a case where it is determined that the color reference member is present, the operation of the needle bar up-down drive mechanism 34 (refer to FIG. 3) is stopped until the processing at Step S20, which will be described later. The sewing machine 1 thus prevents an operation in which the sewing needle 7 pierces the holder plate 90 or the holder member 120 from being performed.

Based on first coordinate data that are stored in the flash memory 64, the CPU 61 controls the drive circuits 72, 73 to move the embroidery frame 50 or the holder member 120 to a position where at least a part of the white color reference member is in the image capture range (more specifically, the unit image capture range) (Step S3). The first coordinate data are coordinate data that indicate a position where at least a part of the white color reference member is in the image capture range. The first coordinate data may differ according to the type of the embroidery frame and the type of the holder member, and they may also be the same. In a case where the first coordinate data differ according to the type of the embroidery frame and the type of the holder member, the CPU 61 performs the processing at Step S3 after acquiring the first coordinate data that correspond to the detection result from the detector 36.

The CPU 61 acquires the first image data from the image sensor 35 and stores the acquired first image data as white color reference image data in the RAM 63 and the flash memory 64 (Step S4). More specifically, at Step S4, the image sensor 35 corrects the image data using the determined WB values, which have been determined by a known method, based on the color information in the image data for the image capture range. From among the image data that have been corrected using the determined WB values, the CPU 61 acquires, as the first image data, data that describe an image that corresponds to the unit image capture range R3. As shown in FIG. 14, an image 301 that is described by the first image data that are acquired at Step S4 is an image in which a portion that shows only the white color reference member 931 has been extracted from an original image that describes the entire image capture range. The CPU 61 acquires the determined WB values that have been output by the image sensor 35 and stores them in the RAM 63 and the flash memory 64 (Step S5).

The CPU 61 sets the AWB of the image sensor 35 to off (Step S6). The CPU 61 sets the MWB of the image sensor 35 to on, with the determined WB values that were acquired at Step S5 defined as the set WB values (Step S7). Based on second coordinate data that are stored in the flash memory 64, the CPU 61 controls the drive circuits 72, 73 to move the embroidery frame 50 or the holder member 120 to a position where at least a part of the black color reference member is in the image capture range (more specifically, the unit image capture range) (Step S8). The second coordinate data are coordinate data that indicate a position where at least a part of the black color reference member is in the image capture range. The second coordinate data may differ according to the type of the embroidery frame and the type of the holder member, and they may also be the same. In a case where the second coordinate data differ according to the type of the embroidery frame and the type of the holder member, the CPU 61 performs the processing at Step S8 after acquiring the second coordinate data that correspond to the detection result from the detector 36.

The CPU 61 acquires the first image data from the image sensor 35 and stores the acquired first image data as black color reference image data in the RAM 63 and the flash memory 64 (Step S9). More specifically, at Step S9, the image sensor 35 corrects the image data using the set WB values that were set at Step S7. From among the image data that have been corrected using the set WB values, the CPU 61 acquires, as the first image data, data that describe an image that corresponds to the unit image capture range. As shown in FIG. 14, an image 302 that is described by the first image data that are acquired at Step S9 is an image in which a portion that shows only the black color reference member 932 has been extracted from the original image that describes the entire image capture range.

On the other hand, in a case where, at Step S1, a determination is made that the color reference member is not present (NO at Step S1), the CPU 61 acquires WB values for the image sensor 35 that are stored in the flash memory 64 (Step S10). The WB values that are acquired at Step S10 are either default values or the values that were stored by the most recent iteration of the processing at Step S5. The CPU 61 acquires the white color reference image data and the black color reference image data that are stored in the flash memory 64 (Steps S11, S12). The white color reference image data and the black color reference image data that are acquired at Steps S11 and S12 are either default values or the values that were stored by the most recent iteration of the processing at Steps S4 and S9. The white color reference image data and the black color reference image data that are acquired at Steps S11 and S12 are data in which the white balance has been adjusted using the WB values that were acquired at Step S10. The CPU 61 sets the MWB of the image sensor 35 to on, with the WB values that were acquired at Step S10 defined as the set WB values (Step S13).

Following Steps S9 and S13, the CPU 61, based on third coordinate data that are stored in the flash memory 64, controls the drive circuits 72, 73 to move the embroidery frame 50 or the holder member 120 to a position where an image of the image capture range will be captured. The CPU 61, synchronizing the control of the drive circuits 72, 73, acquires the second image data by causing the image sensor 35 to capture an image of the image capture range (Step S14). The third coordinate data are coordinate data that indicate a position where at least a part of the image capture object range is in the image capture range (more specifically, the unit image capture range) of the image sensor 35. The third coordinate data are specified based on the detection result from the detector 36. In the specific example, the image capture object range R1 is larger than the image capture range. Therefore, the CPU 61 synchronizes the control of the drive circuits 72, 73 such that image data are acquired for each one of a plurality of image capture ranges by causing the image sensor 35 to capture successive images of the image capture object range R1. The image sensor 35 outputs to the I/O 66 image data that have been corrected using the set WB values that were set at Step S7 (or Step S13). From among the image data that have been corrected by the image sensor 35 using the set WB values, the CPU 61 acquires, as the second image data, the data that describe an image that corresponds to the unit image capture range.

The second image data that are created by the processing at Step S14 correspond to each one of a plurality of images 310 of the left half of the image capture object range R1, for which image capture is performed a plurality of times, and to each one of a plurality of images 340 of the right half of the image capture object range R1, for which image capture is performed a plurality of times. As shown in FIG. 14, the images 310, 340 that are described by the second image data that are acquired at Step S14 are images in which portions that respectively correspond to the images 301, 302 have been extracted from an original image that describes the entire image capture range. The positions, shapes, and sizes of the portions that respectively correspond to the images 301, 302 and have been extracted from the original image are the same as those of the images 301, 302 themselves. Extracting the images that the second image data describe from the original image in this manner makes it possible to regard the image capture conditions for the images 301, 302 and the images 310, 340, such as the brightness and the like, as being nearly the same.

The CPU 61 corrects the second image data based on the white color reference image data and the black color reference image data (Step S15). In the present embodiment, the CPU 61 performs known shading correction on the second image data based on the white color reference image data and the black color reference image data. In the specific example, the pluralities of sets of the second image data that respectively correspond to the pluralities of the images 310, 340 are corrected individually.

The procedure for the shading correction will be briefly explained using a specific example. R, G, B gradation values are acquired for each of the pixels that are arrayed in matrix form, with N rows and M columns (N and M being positive integers), in each of the images that are described by the first image data and the second image data. For a pixel at row N, column M, given that the gradation values for the white color reference image data are W, the gradation values for the black color reference image data are B, and the gradation values for the second image data are 5, post-correction data D are derived by the following equation:

$$\text{Post-correction data } D=(S-B)\times 255/(W-B)$$

In a case where the gradation values W are (240, 232, 238), the gradation values B are (10, 5, 9), and the gradation values S are (54, 152, 43), the CPU 61 computes the (R, G, B) values for the post-correction data D as follows:

$$R=(54-10)\times 255/(240-10)=49$$

$$G=(152-5)\times 255/(232-5)=165$$

$$B=(43-9)\times 255/(238-9)=38$$

The CPU 61 performs these computations for all of the pixels that are contained in the images. As shown in FIG. 14, the processing at Step S15 corrects the second image data that correspond to each one of the plurality of the images 310 and the second image data that correspond to each one of the plurality of the images 340, based on the white color reference image data that describe the image 301 and the black color reference image data that describe the image 302. In FIG. 14, the images that are described by the corrected second image data are the plurality of image 320 and the plurality of images 350.

Based on the second image data that were corrected at Step S15, the CPU 61 creates combined image data that describe the entire image capture object range (Step S16). The combined image data are image data that describe a single combined image that combines the plurality of images that are described by the second image data. In the specific example, the combined image data are created by the procedure hereinafter described, for example. As shown in FIG. 14, based on the sets of the second image data that respectively correspond to the plurality of the images 320, the CPU 61 first creates image data that describe an image 330 of the left half of the image capture object range R1. In the same manner, based on the sets of the second image data that respectively correspond to the plurality of the images 350, the CPU 61 creates image data that describe an image 360 of the right half of the image capture object range R1. Based on the image data that describe the image 350 and the image data that describe the image 360, the CPU 61 creates the combined image data, which describe an image 370 of the entire image capture object range R1.

The CPU 61 creates the embroidery data based on the combined image data that were created at Step S16 (Step S17). A known method (for example, the method that is described in Japanese Laid-Open Patent Publication No. 2009-201704) may be used for the method that creates the embroidery data based on the image data. The embroidery data that are created by the processing at Step S17 include the sewing order, the coordinate data, and the thread color data. The thread color data describe thread colors that are set based on color information on the usable thread colors that is stored in a storage device (for example, the flash memory 64) of the sewing machine 1, the thread colors that are set being those that most closely resemble the color information for the figure that the combined image data describe. In the specific example, the thread colors that are set are those that most closely resemble the first color, the second color, and the third color of the respective FIGS. 201 to 203 that are included in the FIG. 200, and the thread color data are created for those colors. At Step S17, in a case where unintended objects (for example, the magnets 100) are visible in the image that the combined image data describe, for example, the CPU 61 may perform processing that specifies, in accordance with commands from the user, a range within the combined image that is to be referenced during the creating of the embroidery data.

The CPU 61 controls the drive circuit 74 to display a display screen on the LCD 15 (Step S18). For example, the combined image that is described by the combined image data that were created at Step S15, as well as information that is related to the pattern that is described by the embroidery data that were created based on the combined image, may be displayed on the display screen, although this is not shown in the drawings. After checking the display screen, the user mounts on the moving mechanism 40 the embroidery frame 50 that holds the sewing workpiece. The user inputs the command to start the sewing by performing a panel operation or pressing the start/stop switch 29.

The CPU 61 waits until it detects the command to start the sewing (NO at Step S19). In a case where the CPU 61 has detected the command to start the sewing (YES at Step S19), it waits until it detects that the embroidery frame 50 has been mounted, based on the detection result from the detector 36 (NO at Step S20). In a case where the CPU 61 has detected that the embroidery frame 50 has been mounted (YES at Step S20), it controls the drive circuits 72, 73 in accordance with the embroidery data to drive the moving mechanism 40 and move the embroidery frame 50. The CPU 61 synchronizes the drive control of the drive circuits 72, 73 and operates the drive circuit 71 to drive the needle bar up-down drive mechanism 34 (Step S21). The processing at Step S21 causes the plurality of the stitches that express the pattern to be formed in the sewing workpiece that is held by the embroidery frame 50, in accordance with the embroidery data. Note that, at Step S21, in a case where it is necessary to replace the thread for a color change or the like, the CPU 61 suspends the processing at Step S20 and displays information (for example, the color of the upper thread) that pertains to the replacement thread on the LCD 15. After replacing the thread, the user either performs a panel operation or presses the start/stop switch 29 to input a command to restart the sewing. When the CPU 61 detects the command to restart the sewing, the CPU 61 restarts control based on the embroidery data. When the sewing has been completed, the CPU 61 terminates the image capture and sewing processing.

The sewing machine 1 is able to correct the second image data based on the first image data, which were obtained by capturing an image under the same image capture conditions (for example, brightness, light source) as the second image data. The sewing machine 1 is able to correct the second image data using the first image data, which appropriately reflect the actual use environment. In other words, the sewing machine 1 is able to correct the second image data more appropriately than it could if it were to correct the second image data using correction values that were set at the time that the sewing machine 1 was shipped from the factory. Accordingly, the sewing machine 1 is able to acquire the second image data in which the image is described by appropriate colors, such that the coloring of the image is natural.

The sewing machine 1 is able to correct the second image data that are captured for the object that is placed on the planar portion 121, based on the first image data that were captured for at least a portion of the color reference member 123 of the holder member 120. Because the color reference member 123 is provided on the holder member 120, the user does not need to prepare a color reference member that is separate from the holder member 120. The color reference member 123 is provided in the same plane as the planar portion 121 on which the object is placed. The holder member 120 is disposed parallel to the bed 11. Accordingly, the sewing machine 1 is able to use the image sensor 35 to capture images of the color reference member 123 and the object that is placed on the planar portion 121, under conditions in which the color reference member 123 and the object are approximately the same distance from the bed 11. Because the image of the object is captured in a state in which the object is disposed along the flat surface 133, the sewing machine 1 is able to acquire the second image data that describe an image in which deformation of the object that is due to wrinkling, sagging, and the like is reduced.

The sewing machine 1 is able to correct the second image data that are captured for the object that is placed on the planar portion 91, based on the first image data that were captured for at least a portion of the color reference member 93 of the holder plate 90 that is mounted on the embroidery frame 50. Because the color reference member 93 is provided on the holder plate 90, the user does not need to prepare a color reference member that is separate from the holder plate 90. The color reference member 93 is provided in the same plane as the planar portion 91 on which the object is placed. The holder plate 90 is disposed parallel to the bed 11. Accordingly, the sewing machine 1 is able to use the image sensor 35 to capture images of the color reference member 93 and the object that is placed on the planar portion 91, under conditions in which the color reference member 93 and the object are approximately the same distance from the bed 11. Because the image of the object is captured in a state in which the object is disposed along the flat surface 911, the sewing machine 1 is able to acquire the second image data that describe an image in which deformation of the object that is due to wrinkling, sagging, and the like is reduced.

The CPU 61 of the sewing machine 1 can use the processing at Steps S3 and S8 to automatically move one of the embroidery frame 50 and the holder member 120 to a position where at least a portion of the color reference member is within the image capture range of the image sensor 35. The sewing machine 1 can use the processing at Step S14 to automatically move one of the embroidery frame 50 and the holder member 120 to a position where the image capture object range is within the image capture range of the image sensor 35. The sewing machine 1 is able to reduce the possibility that a problem will occur due to one of the color reference member and the image capture object range not being disposed appropriately within the image capture range of the image sensor 35. By performing the simple operation of mounting one of the holder member 120 and the embroidery frame 50 on the moving mechanism 40, the user can cause the sewing machine 1 to create the second image data that have been corrected using the first image data.

Based on the first image data that are captured for the white color reference member, the sewing machine 1 is able to express the colors of an object more appropriately, particularly white and colors that are close to white. Based on the first image data that are captured for the black color reference member, the sewing machine 1 is able to express the colors of an object more appropriately. More specifically, the CPU 61 of the sewing machine 1, by performing at Step S15 the known shading correction that uses the first image data, is able to acquire the second image data in which uneven coloring and uneven lighting have been reduced from what they were prior to the correction.

The first image data that are captured for the white color reference member are corrected using the AWB, so the color of the white color reference member can be expressed more appropriately than it could if the first image data were not corrected using the AWB. The white balance of the first image data that are captured for the black color reference member and the white balance of the second image data that are captured for the object are both adjusted using the same WB values that are used for the first image data that are captured for the white color reference member. The sewing machine 1 is therefore able to correct the white balance of the second image data more precisely by using the first image data that were captured for the color reference members than it could if it were to adjust the white balance using different WB values every time an image is captured. In other words, the sewing machine 1 is able to acquire the second image data in which the image is described by more appropriate colors, such that the coloring of the image is natural.

Even in a case where the color reference members are not used, the sewing machine 1 is able to correct the second image data appropriately by using the default WB values, the white color reference image data, and the black color reference image data that are stored in the flash memory 64.

The CPU 61 of the sewing machine 1 creates the embroidery data based on the second image data that describe the object that was disposed along the flat surface and that have been corrected based on the first image data. Therefore, based on the second image data, the sewing machine 1 is able to recognize the shape, size, and coloring of a figure that is drawn on the object more appropriately than it could if an image were captured of the object that is held by the holder member in a state in which it is wrinkled and sagging. In other words, the sewing machine 1 is better able than the known sewing machine to create, based on the image data that the image sensor 35 has created, embroidery data that make it possible to sew an embroidery pattern that appropriately expresses the figure that is drawn on the object. Because the sewing machine 1 creates the thread color data based on the second image data, in which the image is described by appropriate colors, such that the coloring of the image is natural, the sewing machine 1 is better able than the known sewing machine to sew the embroidery pattern based on embroidery data that reproduce the colors of the figure appropriately.

The sewing machine of the present disclosure is not limited to the embodiment that is described above, and various types of modifications may be made within the scope of the present disclosure. For example, modifications (A) to (E) described below may be made as desired.

(A) The configuration of the sewing machine 1 may be modified as desired. The sewing machine 1 may be an industrial sewing machine, and may also be a multi-needle sewing machine. It is sufficient for the image capture device to be a device that is disposed such that it can capture an image of an area that includes the area below the needle bar 6, and that is capable of creating image data and inputting the image data to the I/O 66. It is acceptable for the image capture device not to have at least one of the AWB and the MWB. The unit image capture range of the image capture device may be modified as desired.

(B) It is acceptable for the sewing machine 1 not to be provided with some or all of the color reference member, the embroidery frame, the holder plate, and the holder member. In the sewing machine 1, either one of the embroidery frame and the holder member may also be formed as a single unit with the moving mechanism 40. The configurations of the embroidery frame, the holder plate, and the holder member may be modified as desired. In a case where the sewing machine 1 is not provided with the color reference member, the sewing machine 1 may perform color-related correction on the second image data using first image data that describe a captured image of a color reference member that the user has prepared (for example, a reflective plate with a known reflectance ratio). In that case, it is preferable for the sewing machine 1 to use images or audio to guide the user in the placing of the color reference member, the timing of the image capture, and the like.

Figure 15:
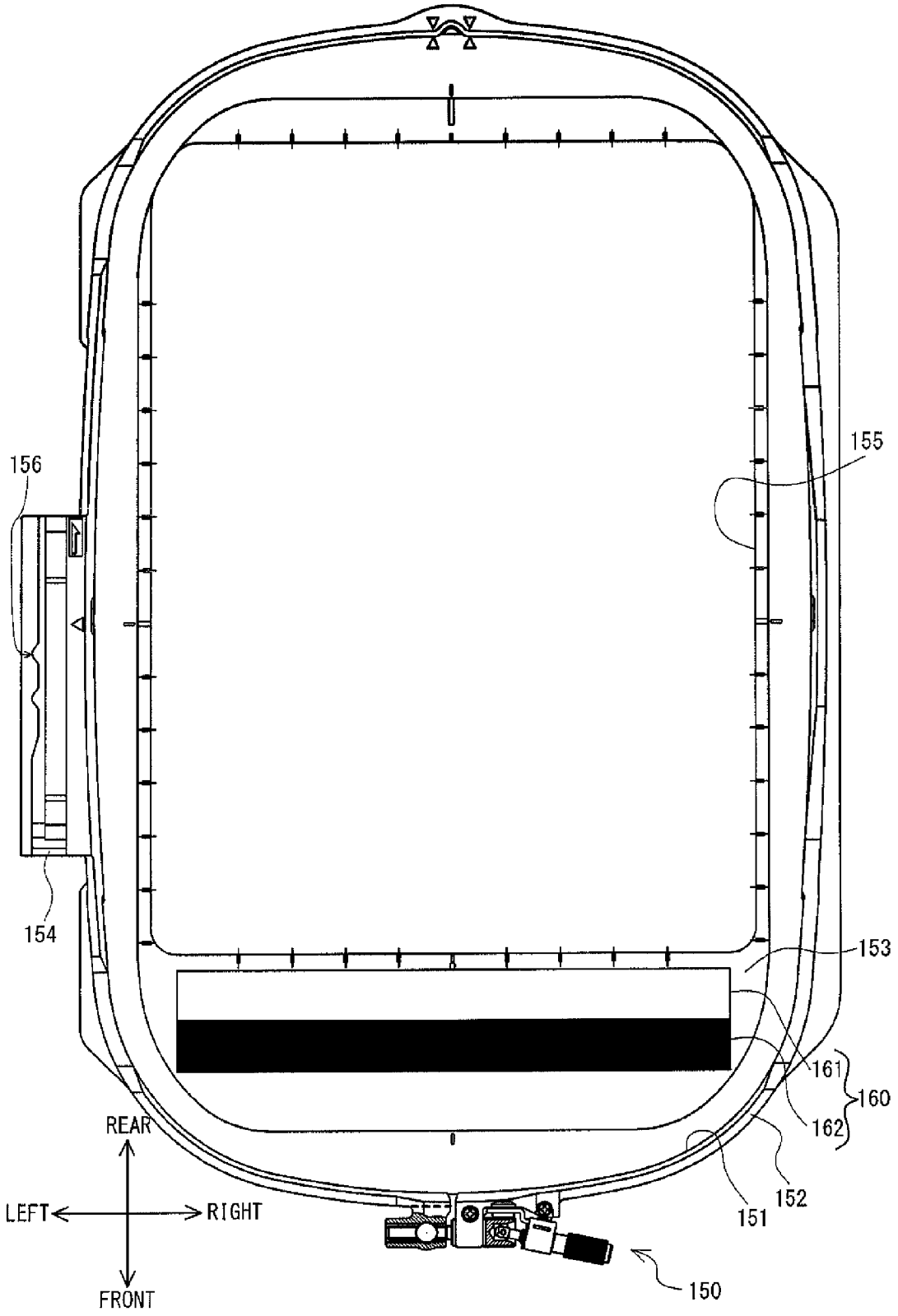
FIG. 15 is a plan view of an embroidery frame 150 in a modified example.

(B-1) The embroidery frame may also have configuration that is provided with a color reference member. Specifically, an embroidery frame 150 that has a color reference member will be explained with reference to FIG. 15. As shown in FIG. 15, the embroidery frame 150 has an inner frame 151 and an outer frame 152, and it holds the sewing workpiece by clamping it between the inner frame 151 and the outer frame 152. The embroidery frame 150 has a mounting portion 154 on the left side face of the outer frame 152. The mounting portion 154 is configured such that it is removably mounted on the moving mechanism 40 of the sewing machine 1. A detected portion 156 is provided on the mounting portion 154. The detected portion 156 has a shape that is particular to the embroidery frame 150. In a case where the embroidery frame 150 is mounted on the moving mechanism 40, the sewing machine 1 is able to specify the mounted embroidery frame 150 based on the shape of the detected portion 156, which is detected by the detector 36 (refer to FIG. 12). In a case where the sewing machine 1 has detected that the embroidery frame 150 is mounted on the moving mechanism 40, the sewing machine 1 sets a sewing-enabled area that corresponds to the embroidery frame 150, the sewing-enabled area being set inside an inner perimeter 155 of the inner frame 151. The inner frame 151 has a planar portion 153 on its front side. The planar portion 153 has a surface that is planar. In a state in which the sewing workpiece is held by the embroidery frame 150, the planar portion 153 is not covered by the sewing workpiece and is exposed such that an image of it can be captured by the image sensor 35.

A color reference member 160 is provided on the planar portion 153 of the embroidery frame 150. In the same manner as the color reference member 93, the color reference member 160 is provided with a white color reference member 161 and a black color reference member 162 that extend in the left-right direction. In a case where the sewing machine 1 creates the second image data for a captured image of the sewing workpiece that is held in the embroidery frame 150, the sewing machine 1 may use the same sort of processing as is shown in FIG. 13 to correct the second image data based on first image data for a captured image of the color reference member 160. The image that is described by the image data that the image sensor 35 has created may be used as a background image when an embroidery pattern is positioned and edited, for example. The embroidery frame may also have a configuration other than that shown in FIG. 15, and may be, for example, a known embroidery frame that has an upper frame and a lower frame and uses the upper frame and the lower frame to clamp the sewing workpiece. In that case, it is preferable for the color reference member to be provided on the upper frame.

In a case where the sewing machine 1 is provided with the embroidery frame 150, the sewing machine 1 is able to correct the second image data that are captured for the object of image capture (for example, the sewing workpiece) that is held by the embroidery frame 150, based on the first image data that were captured for at least a portion of the color reference member 160 of the embroidery frame 150. Because the color reference member 160 is provided on the planar portion 153, the user does not need to prepare a color reference member that is separate from the embroidery frame 150. The color reference member 160 is provided in approximately the same plane as the plane in which the object of the image capture is held. The embroidery frame 150 that is mounted on the moving mechanism 40 is disposed parallel to the bed 11. Accordingly, the sewing machine 1 is able to use the image sensor 35 to capture images of the color reference member 160 and the object of the image capture that is held in the embroidery frame 150, under conditions in which the color reference member 160 and the object of the image capture are approximately the same distance from the bed 11. Because the color reference member 160 is located on the planar portion 153, it is exposed to the image sensor 35 while the object of the image capture is held by the embroidery frame 150. Therefore, after performing the simple operation of mounting the embroidery frame 150 that holds the object of image capture on the moving mechanism 40, the user can use the same sort of processing as is shown in FIG. 13 to cause the sewing machine 1 to acquire the second image data that have been corrected based on the first image data.

Figure 16:
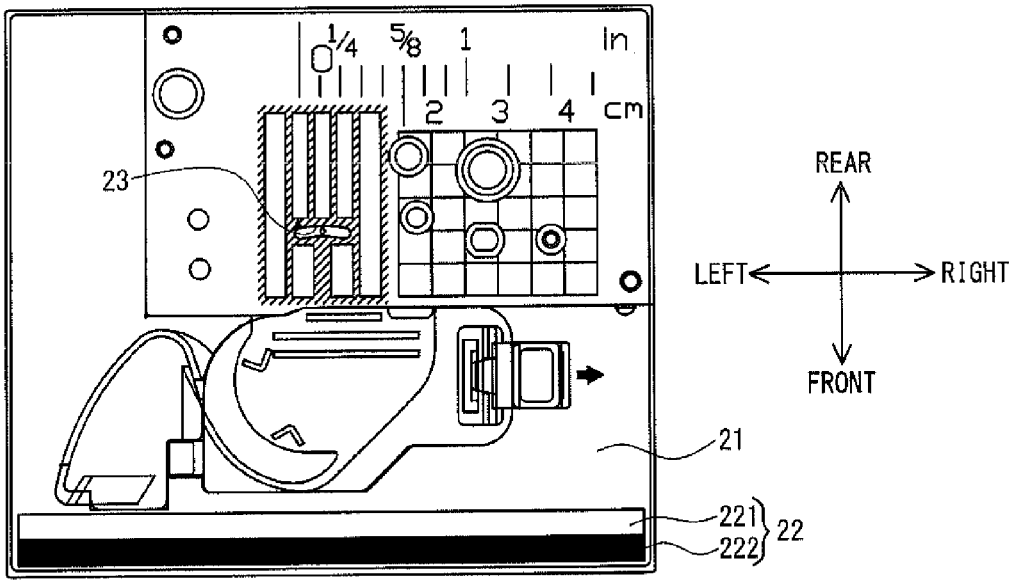
FIG. 16 is a plan view of a needle plate 21 in the modified example.

(B-2) The members of the holder plate 90 may be omitted as desired, and their configurations may be modified. The members of the holder member 120 may also be omitted as desired, and their configurations may be modified. The image capture object range R1 of the holder plate 90 and the image capture object range R2 of the holder member 120 may be modified as desired. The color reference members 93, 123 may each have a configuration in which only one of the white color reference member and the black color reference member is provided. The sewing machine 1 may freely modify the color-related correction processing that uses the first image data, in accordance with the color reference member. The positionings, the sizes, and the shapes, and the like of the color reference members 93, 123 may be modified as desired. For example, the color reference members may be provided over the entire image capture object ranges of the planar portions 91, 121. In that case, the first image data may be captured in a state in which the object is not affixed to the planar portions 91, 121, that is, in a state in which the color reference members are exposed to the image sensor 35. The second image data may be captured in a state in which the object is affixed to the planar portions 91, 121, that is, in a state in which the color reference members are not exposed to the image sensor 35, (C) The color reference member may also be provided on the needle plate 21 (refer to FIG. 3). A color reference member 22 that is provided on the needle plate 21 will be explained with reference to FIG. 16. The left-right direction, the top side, and the bottom side in FIG. 16 respectively define the left-right direction, the rear side, and the front side of the needle plate 21. As shown in FIG. 16, the color reference member 22 is provided such that it extends in the left-right direction along the front side of the needle plate 21. The color reference member 22 includes a white color reference member 221 that serves as a reference for the color white and a black color reference member 222 that serves as a reference for the color black. The sizes of the white color reference member 221 and the black color reference member 222 are set by taking into consideration the unit image capture range of the image sensor 35, for example. In a case where the sewing machine 1 creates the second image data for the sewing workpiece that is disposed on the bed 11, the sewing machine 1 may use the same sort of processing as is shown in FIG. 13 to correct the second image data based on the first image data for a captured image of the color reference member 22. The image that is described by the image data that the image sensor 35 has created may be used as a background image when an embroidery pattern is positioned and edited, for example.

The sewing machine 1 is able to correct the second image data using the first image data for a captured image of the color reference member 22 that is provided on the needle plate 21. Because the color reference member 22 is provided on the needle plate 21, the user does not need to prepare a separate color reference member. The type, the shape, the size, the positioning, and the like of the color reference member 22 in the modified example may be modified as desired. A color reference member may also be provided on the top face of the bed 11 instead of being provided on the needle plate 21.

(D) The program that includes instructions for performing the image capture and sewing processing in FIG. 13 need only be stored in a storage device of the sewing machine 1 until the sewing machine 1 executes the program. Therefore, the method by which the program is acquired, the route by which it is acquired, and the device in which the program is stored may each be modified as desired. A program that the processor of the sewing machine 1 executes may be received from another device by cable or by wireless communication, and may be stored in a storage device such as a flash memory or the like. The other device may be a PC or a server that is connected through a network, for example.

(E) The individual steps in the image capture and sewing processing in FIG. 13 are not limited to the example in which they are performed by the CPU 61, and some or all of them may also be performed by another electronic device (for example, an ASIC). The individual steps in the processing described above may also be performed by distributed processing by a plurality of electronic devices (for example, a plurality of CPUs). In the image capture and sewing processing described above, the order of the steps may be modified as necessary, and individual steps may be omitted and added as necessary. A case in which some or all of the actual processing is performed by an operating system (OS) or the like that operates in the sewing machine 1 based on commands from the CPU 61 of the sewing machine 1, with the functions of the embodiment that is described above being implemented by that processing, is included within the scope of the present disclosure. For example, modifications (E-1) to (E-5) described below may be made to the image capture and sewing processing in FIG. 13 as desired.

(E-1) In a case where the image capture device is provided with only the MWB, image data that have been corrected using WB values that were either stored in advance or set by the user may be acquired as the first image data and the second image data, Therefore, the processing at Steps S2, S6, S7, and S13 may be omitted or modified as desired. Instead of the image sensor 35, the CPU 61 may perform the processing that adjusts the white balance of the image data.

(E-2) The determination at Step S1 as to whether the color reference member is present may also be made based on results of an analysis of the image data. In a case where the determination is made at Step S1 that the color reference member is not present (NO at Step S1), the CPU 61 may omit the processing at Steps 10 to 13 and at Step S15, and it may also omit the processing that corrects the second image data using the first image data. In a case where the determination is made at Step S1 that the color reference member is not present (NO at Step S1), the processing that corrects the second image data using the first image data may be performed based on data that correspond to one mode that the user has selected from among a plurality of modes that are stored in a storage device (for example, the flash memory 64) in advance. The plurality of the modes may be, for example, an indoor mode, an outdoor mode, a fluorescent lighting mode, and the like, for which the image capture conditions, such as the brightness, the use environment, and the like, are different. The data that correspond to the modes include, for example, the WB values, the white color reference image data, and the black color reference image data.

(E-3) In a case where the unit image capture range is larger than the image capture object range, the CPU 61, after moving the holder member 120 or the embroidery frame 50 to a position where the entire image capture object range is within the unit image capture range at Step S14, may create the second image data that describe the image of the unit image capture range. The CPU 61 may omit the processing at Step S16. At Steps S3, S8, and S14, the CPU 61 may control the moving mechanism 40 in accordance with commands that the user inputs through a panel operation or the like.

(E-4) The method for performing the color-related correction on the second image data at Step S15 using the first image data may be modified as desired. The color information for the image data may be expressed by something other than the RGB gradation values.

(E-5) The use of the second image data that have been corrected according to the first image data may be modified as desired. The image that is described by the second image data may be used as a background image when an embroidery pattern is positioned and edited, for example. In that case, the processing at Steps S16 to S21 may be omitted as necessary.

What is claimed is:

1. A sewing machine, comprising:

a needle bar on which a sewing needle is configured to be mounted a lower end of the needle bar;

an image capture device that is configured to capture an image of an area that includes an area below the needle bar, and that is configured to create image data; and a control device that is configured to execute steps of causing the image capture device to create first image data, causing the image capture device to create second image data, acquiring the first image data, acquiring the second image data, and performing color-related correction on the second image data, based on the first image data.

2. The sewing machine according to claim 1, further comprising:

a color reference member that indicates a color that serves as a reference; and a holder member that is configured to hold an object of image capture, wherein the acquiring the first image data includes acquiring the first image data for an image in which at least a portion of the color reference member has been captured, and the performing the color-related correction includes performing the color-related correction on the second image data based on the color of the color reference member that is described by the first image data.

3. The sewing machine according to claim 2, wherein the color reference member is provided as an integral part of the holder member.

4. The sewing machine according to claim 2, wherein the color reference member is configured to be removably mounted on the holder member.

5. The sewing machine according to claim 2, further comprising:

a needle plate that has a needle hole through which the sewing needle is passed, wherein the color reference member is provided in the needle plate.

6. The sewing machine according to claim 2, further comprising:

a moving device that is configured to move the holder member, wherein the control device further configured to execute steps of causing the moving device to move the holder member to a first position, where at least a portion of the color reference member of the holder member is within an image capture range of the image capture device, and causing the moving device to move the holder member to a second position, where at least a portion of the object of image capture that the holder member is holding is within the image capture range of the image capture device.

7. The sewing machine according to claim 2, wherein the holder member is an embroidery frame that includes a first frame member and a second frame member and that is able to hold a sewing workpiece that is the object of image capture using the first frame member and the second frame member, and the color reference member is provided on at least one of the first frame member and the second frame member, and is provided on the one of the first frame member and the second frame member on which the color reference member is not covered by the sewing workpiece when the sewing workpiece is held by the first frame member and the second frame member, such that the color reference member is exposed and an image of the color reference member is able to be captured by the image capture device.

8. The sewing machine according to claim 2, wherein the color reference member includes a white color reference member that serves as a reference for the color white, and the performing the color-related correction includes performing the color-related correction on the second image data based on the color of the white color reference member that is described by the first image data.

9. The sewing machine according to claim 8, wherein the image capture device has an auto white balance function that performs color temperature correction on the image data using determined white balance values that are determined based on color information in the image data, and the causing the image capture device to create the first image data includes causing the image capture device to create the first image data for a captured image of the white color reference member, under the condition that the first image data are corrected using the auto white balance function.

10. The sewing machine according to claim 8, wherein the color reference member further includes a black color reference member that serves as a reference for the color black, and the performing the color-related correction includes performing the color-related correction on the second image data based on the color of the white color reference member and the color of the black color reference member that are described by the first image data.

11. The sewing machine according to claim 9, wherein the image capture device has a manual white balance function that performs color temperature correction on the image data using set white balance values, the color reference member further includes a black color reference member that serves as a reference for the color black, and the causing the image capture device to create the first image data includes causing the image capture device to create the first image data for a captured image of the black color reference member, under the condition that the first image data is corrected using the manual white balance function, with the determined white balance values serving as the set white balance values, and the causing the image capture device to create the second image data includes causing the image capture device to create the second image data, under the condition that the second image data is corrected using the manual white balance function, with the determined white balance values serving as the set white balance values.

12. The sewing machine according to claim 1, wherein the image capture device has a manual white balance function that performs color temperature correction on the image data using set white balance values, and further comprises:

a storage device that is configured to store white balance values and to store the first image data, which have been created under the condition that they were corrected using the stored white balance values, wherein the causing the image capture device to create the second image data includes the causing the image capture device to create the second image data, under the condition that the second image data are corrected using the manual white balance function, with the white balance values that are stored in the storage device serving as the set white balance values, and the performing the color-related correction includes performing the color-related correction on the second image data, based on the first image data that are stored in the storage device.

13. The sewing machine according to claim 6, wherein the control device further configured to execute steps of creating, based on the second image data that have been corrected by the control device, embroidery data for sewing a pattern that is described by the second image data, the embroidery data including at least coordinate data that describe a move position to which the holder member is moved by the moving device, and the causing the moving device to move the holder member includes causing the moving device to move the holder member based on the created embroidery data.

14. A non-transitory computer-readable medium storing a control program that is executable on a sewing machine that is provided with an image capture device, the program comprising computer-readable instructions that, when executed, cause the sewing machine to perform the steps of:

creating first image data by the image capture device;

creating second image data by the image capture device;

acquiring first image data that describe a captured image of an area that includes an area below a needle bar;

acquiring second image data that describe a captured image of the area that includes the area below the needle bar; and performing color-related correction on the second image data, based on the first image data.

* * * * *